US012091757B2

(12) United States Patent
Tsuji et al.

(10) Patent No.: US 12,091,757 B2
(45) Date of Patent: Sep. 17, 2024

(54) METHOD FOR PICKLING STEEL PLATE AND PICKLING APPARATUS

(71) Applicant: PRIMETALS TECHNOLOGIES JAPAN, LTD., Hiroshima (JP)

(72) Inventors: Kosei Tsuji, Hiroshima (JP); Ryusuke Nakatsuka, Hiroshima (JP); Masashi Yoshikawa, Tokyo (JP); Takuya Hirata, Tokyo (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 405 days.

(21) Appl. No.: 17/607,781

(22) PCT Filed: Jan. 9, 2020

(86) PCT No.: PCT/JP2020/000460
§ 371 (c)(1),
(2) Date: Oct. 29, 2021

(87) PCT Pub. No.: WO2021/140612
PCT Pub. Date: Jul. 15, 2021

(65) Prior Publication Data

US 2022/0220619 A1 Jul. 14, 2022

(51) Int. Cl.
*C23G 1/08* (2006.01)
*C23G 3/02* (2006.01)

(52) U.S. Cl.
CPC ..... *C23G 1/08* (2013.01); *C23G 3/021* (2013.01); *C23G 3/025* (2013.01)

(58) Field of Classification Search
CPC ..... C23G 1/08; C23G 3/021; C23G 3/025; C23G 1/081; C23G 1/083; C23G 1/085; C23G 1/088; C23G 1/36
See application file for complete search history.

(56) References Cited

U.S. PATENT DOCUMENTS 5,154,774 A * 10/1992 Bousquet ..... C23G 1/086 134/41
5,690,748 A * 11/1997 Henriet ..... C23G 1/086 252/79.3

(Continued)

FOREIGN PATENT DOCUMENTS

EP 0 505 606 A1 9/1992
JP 62-501981 A 8/1987

(Continued)

OTHER PUBLICATIONS

Extended European Search Report dated Jul. 28, 2022 issued to the corresponding European Application No. 20911916.3.

(Continued)

*Primary Examiner* — Duy N Deo
*Assistant Examiner* — Christopher Remavege
(74) *Attorney, Agent, or Firm* — Birch, Stewart, Kolasch & Birch, LLP

(57) ABSTRACT

A method for pickling a steel plate having a first steel plate portion and a second steel plate portion which is connected to a tail end of the first steel plate portion and which requires a longer time for pickling than the first steel plate portion when pickled under the same condition includes: a step of pickling the steel plate by immersing the steel plate in an acid solution in at least one pickling tank while conveying the steel plate; a step of circulating the acid solution, through a circulation line connected to any of the at least one pickling tank, between the pickling tank and an oxidizing device disposed in the circulation line; a step of oxidizing $Fe^{2+}$ in the acid solution to $Fe^{3+}$ by the oxidizing device using a gaseous oxidant; and a feeding start step of, upon switching from pickling of the first steel plate portion to pickling of the second steel plate portion, starting feeding of a liquid oxidant for oxidizing $Fe^{2+}$ in the acid solution to (Continued)

$Fe^{3+}$ to any of the at least one pickling tank or to the circulation line.

15 Claims, 12 Drawing Sheets

(56) References Cited

U.S. PATENT DOCUMENTS

| | | | | |
|---|---|---|---|---|
| 5,785,765 | A * | 7/1998 | Zavattoni | C23G 1/36 134/41 |
| 5,810,939 | A | 9/1998 | Angel et al. | |
| 5,851,304 | A | 12/1998 | Giraud et al. | |
| 5,958,147 | A * | 9/1999 | Berglind | C23G 1/103 510/109 |
| 5,992,196 | A | 11/1999 | Giraud et al. | |
| 6,033,485 | A | 3/2000 | Didier et al. | |
| 6,210,491 | B1 * | 4/2001 | Colgan | C23G 1/086 134/28 |
| 6,250,314 | B1 * | 6/2001 | Wasserbauer | C23G 1/08 134/40 |
| 6,500,328 | B1 * | 12/2002 | Fortunati | C23G 1/081 134/41 |
| 2010/0122712 | A1 | 5/2010 | Madi et al. | |
| 2014/0199221 | A1 * | 7/2014 | Suchak | B01D 53/68 423/235 |

FOREIGN PATENT DOCUMENTS

| | | | |
|---|---|---|---|
| JP | 1-165783 | A | 6/1989 |
| JP | 9-170090 | A | 6/1997 |
| JP | 4186131 | B2 | 11/2008 |
| JP | 2012-508820 | A | 4/2012 |
| WO | WO 2004/020700 | A1 | 3/2004 |

OTHER PUBLICATIONS

Office Action dated Feb. 15, 2023 issued in counterpart Chinese Application No. 202080040682.2.

Indian Office Action for Indian Application No. 202117054453, dated Sep. 2, 2022, with an English translation.

Japanese Office Action for Japanese Application No. 2021-569663, dated Aug. 30, 2022.

* cited by examiner

METHOD FOR PICKLING STEEL PLATE AND PICKLING APPARATUS

TECHNICAL FIELD

The present disclosure relates to a method for pickling a steel plate and a pickling apparatus.

BACKGROUND ART

In pickling of a steel plate, it is known that the pickling speed can be increased by adjusting the concentration of ferric ion ($Fe^{3+}$) contained in the acid solution, and methods for adjusting the $Fe^{3+}$ in the acid solution have been proposed.

For instance, Patent Document 1 discloses performing aeration of the acid solution to oxidize ferrous ion ($Fe^{2+}$) which is generated in the acid solution during pickling and increase the concentration of $Fe^{3+}$ contained in the acid solution, in order to maintain the concentration of $Fe^{3+}$ in the acid solution within a predetermined range.

CITATION LIST

Patent Literature

Patent Document 1: JP4186131B

SUMMARY

Problems to be Solved

Meanwhile, in a case where a gaseous oxidant (air or oxygen, for instance) is used to adjust the concentration of iron ion in the acid solution, the oxidation reaction of iron ion ($Fe^{2+}$ to $Fe^{3+}$) is relatively slow, as the rate of dissolution of the gaseous oxidant to the acid solution is limited. Thus, when the steel plate to be pickled is switched to a pickling-resistant member (steel plate that requires a longer time to be pickled), it is necessary to reduce the line speed compared to the previous speed. Furthermore, even when the concentration of $Fe^{3+}$ in the acid solution is to be increased by adjusting the supply amount of the gaseous oxidant or the like, it takes a long time to increase the concentration of $Fe^{3+}$, and thus it is not possible to increase the line speed much during a period after the line speed is reduced as described above and until the concentration of $Fe^{3+}$ in the acid solution increases. Thus, the production efficiency of the steel plate may deteriorate.

In view of the above, an object of at least one embodiment of the present invention is to provide a method for pickling a steel plate capable of improving the production efficiency of the steel plate.

Solution to the Problems

According to at least one embodiment of the present invention, a method for pickling a steel plate having a first steel plate portion and a second steel plate portion which is connected to a tail end of the first steel plate portion and which requires a longer time for pickling than the first steel plate portion when pickled under the same condition, includes: a step of pickling the steel plate by immersing the steel plate in an acid solution in at least one pickling tank while conveying the steel plate; a step of circulating the acid solution, through a circulation line connected to any of the at least one pickling tank, between the pickling tank and an oxidizing device disposed in the circulation line; a step of oxidizing $Fe^{2+}$ in the acid solution to $Fe^{3+}$ by the oxidizing device using a gaseous oxidant; and a feeding start step of, upon switching from pickling of the first steel plate portion to pickling of the second steel plate portion, starting feeding of a liquid oxidant for oxidizing $Fe^{2+}$ in the acid solution to $Fe^{3+}$ to any of the at least one pickling tank or to the circulation line.

Advantageous Effects

According to at least one embodiment of the present invention, provided is a method of pickling a steel plate capable of improving the production efficiency of the steel plate.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

(Configuration of Pickling Apparatus)

FIGS. 1A to 4 are each a schematic diagram of a pickling facility to which a pickling method according to some embodiments is to be applied. The pickling apparatus 1 depicted in FIGS. 1A to 4 is a pickling apparatus for pickling a steel plate 2 by using an acid solution 3.

Figure 1A:
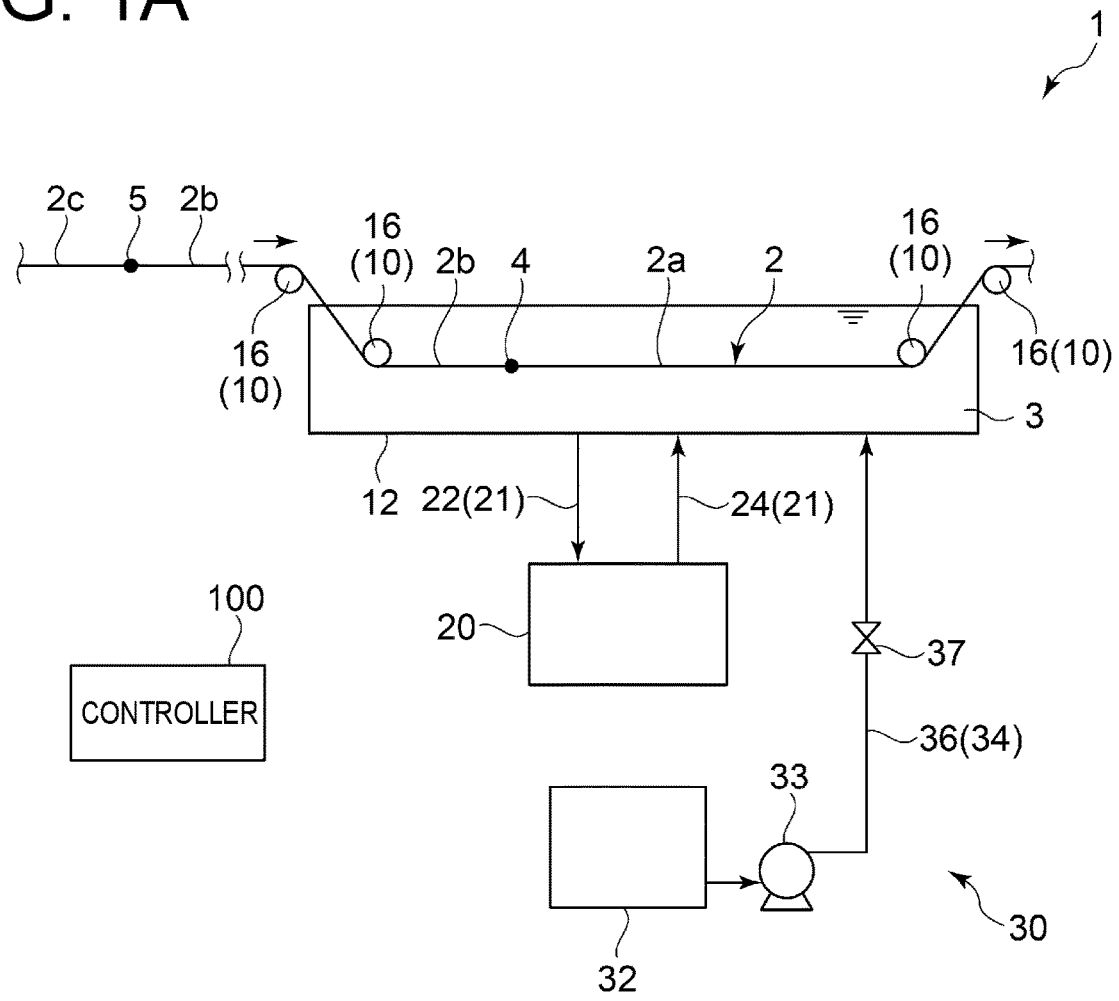
FIG. 1A is a schematic diagram of a pickling facility according to an embodiment.
Figure 1B:
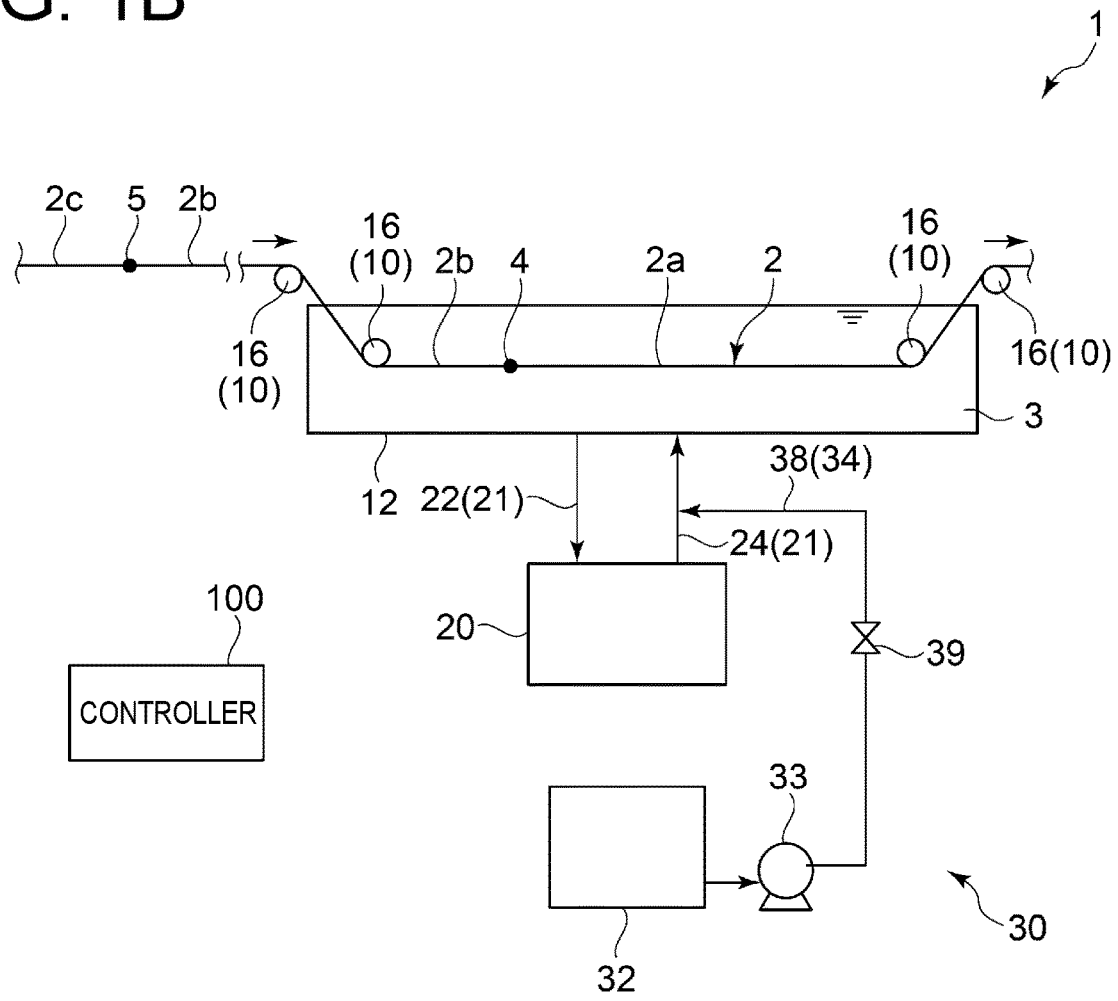
FIG. 1B is a schematic diagram of a pickling facility according to an embodiment.
Figure 1C:
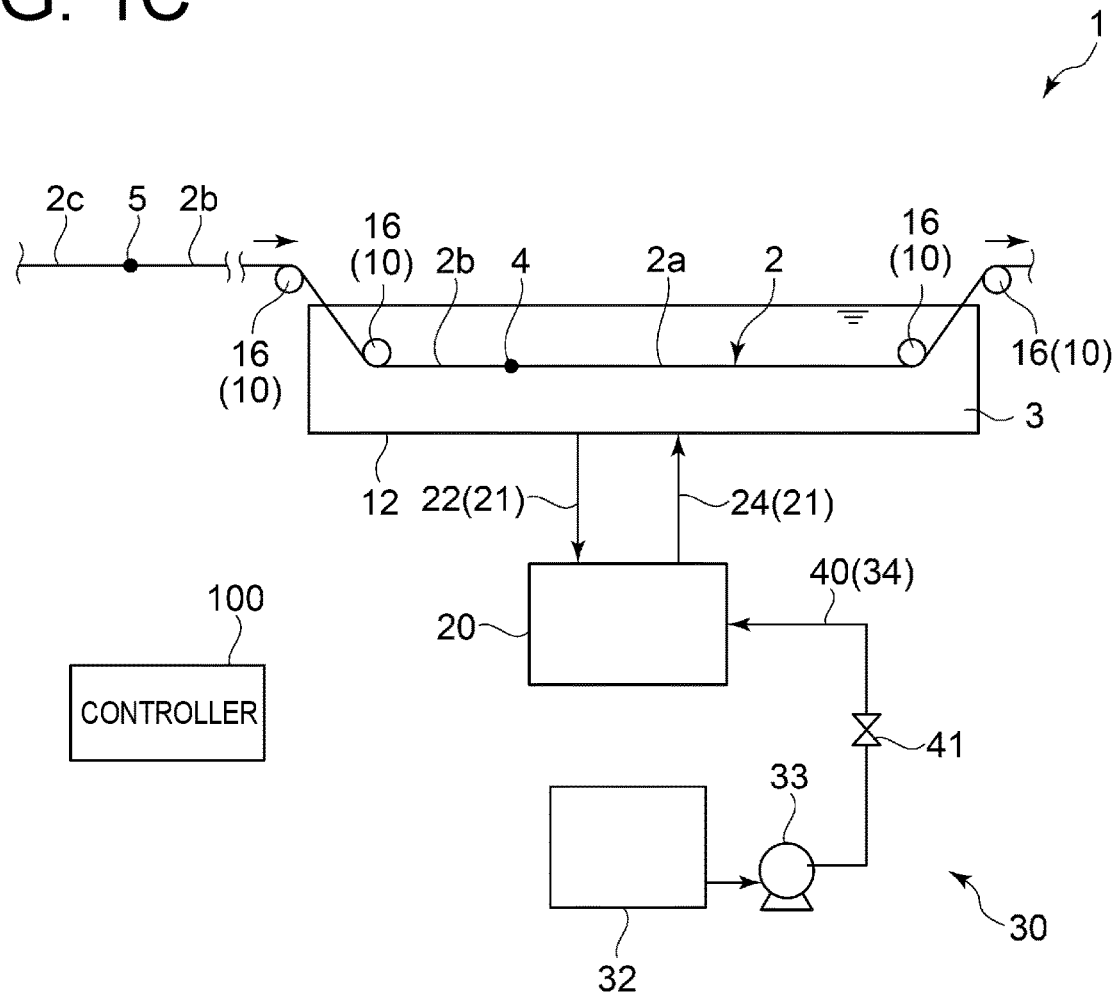
FIG. 1C is a schematic diagram of a pickling facility according to an embodiment.

As depicted in FIGS. 1A to 1C, the pickling apparatus 1 includes a pickling tank 12 for storing an acid solution 3, and a conveyance roll 16 (conveyance part 10) for continuously conveying a steel plate 2 having a plate shape immersed in the acid solution 3. The acid solution 3 is a pickling liquid for dissolving and removing the scale (oxide layer) formed on the surface of the steel plate 2. For instance, the acid solution 3 is a liquid containing acid such as hydrochloric acid, sulfuric acid, nitric acid, or hydrofluoric acid. The conveyance roll 16 is configured to apply tension to the steel plate 2 and convey the steel plate 2 while the steel plate 2 is immersed in the acid solution in the pickling tank. A plurality of conveyance rolls 16 may be provided and configured to be driven by a motor 17 (see FIG. 10).

Figure 2:
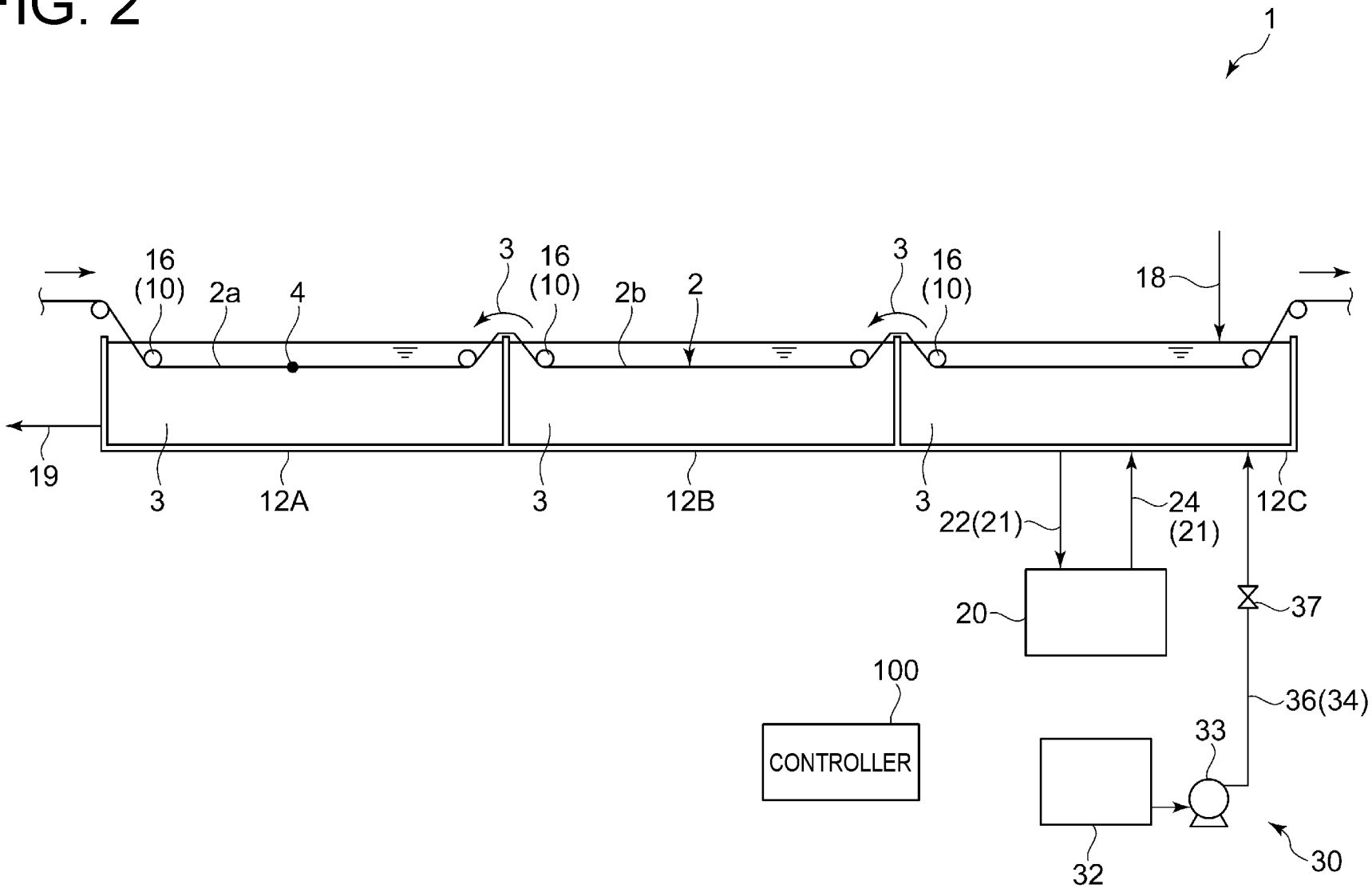
FIG. 2 is a schematic configuration diagram of a pickling facility according to an embodiment.
Figure 3:
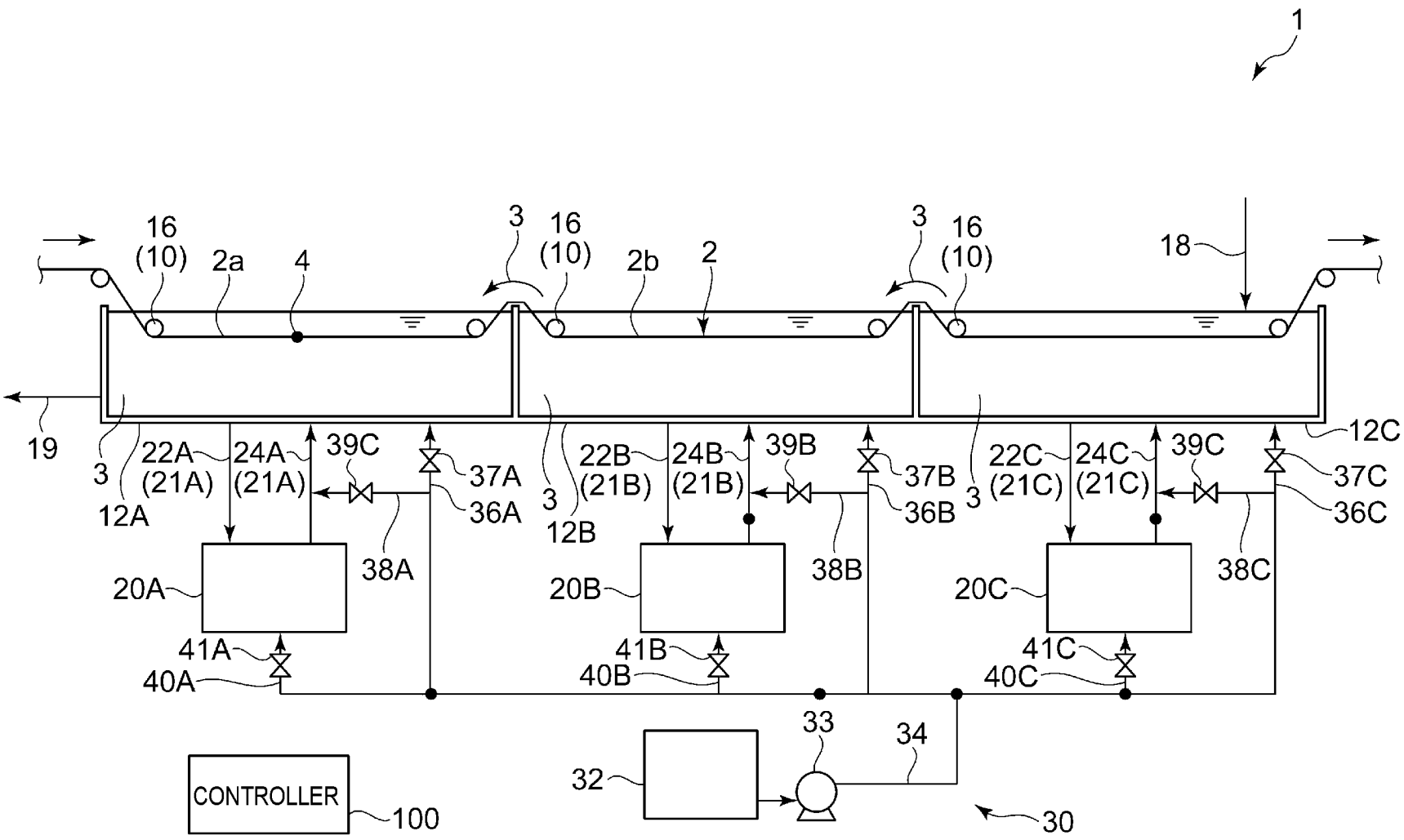
FIG. 3 is a schematic configuration diagram of a pickling facility according to an embodiment.
Figure 4:
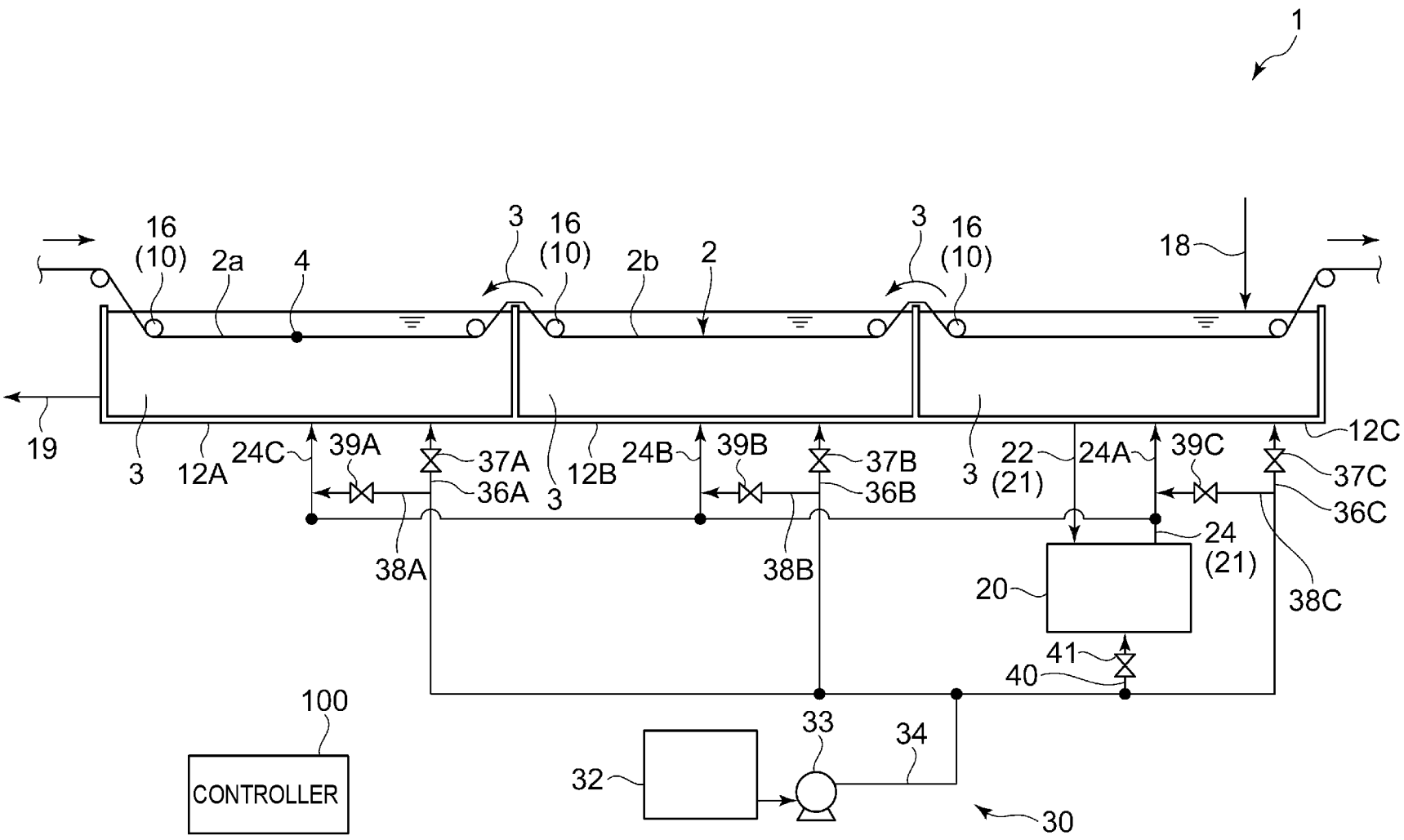
FIG. 4 is a schematic configuration diagram of a pickling facility according to an embodiment.

The pickling apparatus 1 depicted in FIGS. 2 to 4 is a pickling apparatus 1 which includes a plurality of pickling tanks 12 (12A to 12C) arranged in series in the conveyance direction of the steel plate 2. The plurality of pickling tanks 12 (12A to 12C) are partitioned by partition walls.

The plurality of pickling tanks 12 (12A to 12C) have respective conveyance rolls 16 (conveyance parts 10), and the conveyance rolls 16 convey the steel plate 2 while the steel plate 2 is immersed in the acid solution 3 in the plurality of pickling tanks 12.

In the pickling apparatus 1 depicted in FIGS. 2 to 4, the acid solution 3 for pickling the steel plate 2 is supplied to the pickling tank 12C at the most downstream side, via an acid-solution supply part 18. Furthermore, the acid solution 3 overflown from the pickling tanks 12 (12A to 12C) is conveyed to a pickling tank at the upstream side, over the partition wall between the pickling tanks 12. The pickling tank 12A at the most upstream side has an acid-solution discharge part 19 for discharging the acid solution 3.

The pickling apparatus 1 includes a circulation line 21, connected to the pickling tank 12, for circulating the acid solution 3 in the pickling tank 12, and an oxidizing device 20 disposed in the circulation line 21. The circulation line 21 includes an extract line 22 for extracting the acid solution 3 from the pickling tank 12 and introducing the acid solution 3 to the oxidizing device 20, and a return line 24 for returning the acid solution 3 from the oxidizing device 20 to the pickling tank 12.

The oxidizing device 20 is configured to oxidize $Fe^{2+}$ in the acid solution 3 to $Fe^{3+}$ by using a gaseous oxidant. Although not illustrated, the oxidizing device 20 may include an airtight tank, and a gas supply part for supplying the gaseous oxidant to the airtight tank. The oxidizing device 20 may be configured such that the concentration of $Fe^{3+}$ in the acid solution inside the oxidizing device 20 is adjustable by adjusting the partial pressure of the gaseous oxidant inside the oxidizing device 20.

In pickling of a steel plate, it is known that the pickling speed can be increased by adjusting the concentration of ferric ion ($Fe^{3+}$) contained in the acid solution. That is, it is known that the concentration ratio of iron ion ($Fe^{2+}$, $Fe^{3+}$) in the acid solution and the pickling time has a predetermined relationship, and the pickling speed increases (that is, the pickling times becomes shorter) when the concentration of $Fe^{3+}$ in the acid solution is increased to some extent. Accordingly, by adjusting the concentration of $Fe^{3+}$ in the acid solution appropriately with the oxidizing device 20, it is possible to pickle a steel plate efficiently.

The gaseous oxidant used in the oxidizing device 20 may contain air, oxygen, or ozone, for instance.

In a pickling apparatus including the plurality of pickling tanks 12 (12A to 12C), a circulation line 21 connected to one of the plurality of pickling tanks 12 may be provided, and the oxidizing device 20 may be disposed in the circulation line 21. In the illustrative embodiment depicted in FIGS. 2 and 4, a circulation line 21 (including an extract line 22 and a return line 24) is connected to the pickling tank 12C at the most downstream side of the plurality of pickling tanks 12 (12A to 12C), and the oxidizing device 20 is disposed in the circulation line 21. In the illustrative embodiment depicted in FIG. 4, the return line 24 includes return lines 24A to 24C respectively connected to the plurality of pickling tanks 12A to 12C.

Alternatively, in the pickling apparatus including the plurality of pickling tanks 12 (12A to 12C), circulation lines 21 respectively connected to two or more of the plurality of pickling tanks 12 may be provided, and the oxidizing device 20 may be disposed in each of the circulation lines 21. In the illustrative embodiment depicted in FIG. 3, circulation lines 21A to 21C (including extract lines 22A to 22C and return lines 24A to 24C) are provided so as to correspond to the plurality of pickling tanks 12 (12A to 12C) respectively, and oxidizing devices 20A to 20C are disposed in the circulation lines 21A to 21C, respectively.

Furthermore, in the illustrative embodiment depicted in FIGS. 2 to 4, the acid solution 3 from the oxidizing device 20 is supplied to the pickling tank 12C at the most downstream side.

The pickling tank 12 at the downstream side may perform, in addition to dissolution of scale on the surface of the steel plate 2, dissolution of the base material surface of the steel plate 2. In a case where the base material of the steel plate 2 is dissolved by the acid solution as described above, $Fe^{3+}$ in the acid solution is consumed. Thus, by supplying the acid solution 3 whose $Fe^{3+}$ concentration is increased by the oxidizing device 20 to the downstream pickling tank of the plurality of pickling tanks 12 (e.g., the pickling tank 12C at the downstream side), it is possible to pickle the steel plate 2 effectively.

The pickling apparatus 1 further includes, in one of the at least one pickling tank 12 or in the circulation line 21, a liquid oxidant feeding part 30 capable of feeding a liquid oxidant for oxidizing the $Fe^{2+}$ in the acid solution 3 to $Fe^{3+}$. The liquid oxidant feeding part 30 includes a liquid oxidant tank 32 for storing a liquid oxidant, a liquid oxidant feeding line 34 for feeding the liquid oxidant from the liquid oxidant tank 32, and a liquid oxidant pump 33 disposed in the liquid oxidant feeding line 34 for pressurizing the liquid oxidant.

The liquid oxidant is not particularly limited, and any liquid having the capacity to oxidize iron ion ($Fe^{2+}$) may be used as the liquid oxidant. The liquid oxidant may include, for instance, at least one of hydrogen peroxide solution, hypochlorous acid, ammonium peroxydisulfate (ammonium persulfate), or potassium permanganate solution.

The liquid oxidant feeding line 34 is connected to the pickling tank 12 or the circulation line 21 (including the oxidizing device 20 disposed in the circulation line 21), and is configured to feed the liquid oxidant from the liquid oxidant tank 32 to the pickling tank 12 or the circulation line 21 (including the oxidizing device 20 disposed in the circulation line 21).

In the illustrative embodiment depicted in FIGS. 1A and 2 to 4, the liquid oxidant feeding line 34 includes a first feeding line 36 connected to the pickling tank 12 and configured to feed the liquid oxidant to the pickling tank 12. The first feeding line 36 has a valve 37 disposed therein, for adjusting the supply amount of the liquid oxidant to the pickling tank 12 via the first feeding line 36. Furthermore, in the illustrative embodiment depicted in FIGS. 3 and 4, the liquid oxidant feeding line 34 includes first feeding lines 36A to 36C connected to the pickling tanks 12A to 12C respectively, and configured to feed the liquid oxidant to the pickling tanks 12A to 12C respectively. The first feeding lines 36A to 36C have valves 37A to 37C disposed therein, respectively, for adjusting the supply amount of the liquid oxidant to the pickling tanks 12A to 12C via the first feeding lines 36A to 36C, respectively.

In the illustrative embodiment depicted in FIGS. 1B, 3, and 4, the liquid oxidant feeding line 34 includes a second feeding line 38 connected to the return line 24 (circulation line 21) between the oxidizing device 20 and the pickling tank 12, and configured to feed the liquid oxidant to the return line 24. The second feeding line 38 has a valve 39 disposed therein, for adjusting the supply amount of the liquid oxidant to the return line 24 via the second feeding line 38. Furthermore, in the illustrative embodiment depicted in FIGS. 3 and 4, the liquid oxidant feeding line 34 includes second feeding lines 38A to 38C connected to the return lines 24A to 24C respectively, and configured to feed the liquid oxidant to the return lines 24A to 24C respectively. The second feeding lines 38A to 38C have valves 39A to 39C disposed therein, respectively, for adjusting the supply amount of the liquid oxidant to the return lines 24A to 24C via the second feeding lines 38A to 38C, respectively.

In the illustrative embodiment depicted in FIGS. 1C, 3 and 4, the liquid oxidant feeding line 34 includes a third feeding line 40 connected to the oxidizing device 20 in the circulation line 21 (circulation line 21), and configured to feed the liquid oxidant to the oxidizing device 20. The third feeding line 40 has a valve 41 disposed therein, for adjusting the supply amount of the liquid oxidant to the oxidizing device 20 via the third feeding line 40. Furthermore, in the illustrative embodiment depicted in FIG. 3, the liquid oxidant feeding line 34 includes third feeding lines 40A to 40C connected to the oxidizing devices 20A to 20C respectively, and configured to feed the liquid oxidant to the oxidizing devices 20A to 20C respectively. The third feeding lines 40A to 40C have valves 41A to 41C disposed therein, respectively, for adjusting the supply amount of the liquid oxidant to the oxidizing devices 20A to 20C via the third feeding lines 40A to 40C, respectively.

The pickling apparatus 1 may include a controller 100 for adjusting the concentration of $Fe^{3+}$ in the acid solution inside the pickling tanks 12 (12A to 12C) or the conveyance speed (line speed) of the steel plate 2. The specific configuration of the controller 100 will be described later.

The controller 100 may include a processor, a memory (RAM), an auxiliary storage part, and an interface, for instance. The controller 100 is configured to receive signals from the above various measurement instruments via the interface. The processor is configured to process the accordingly received signals. Furthermore, the processor is configured to process programs expanded in the memory.

The content of process by the controller 100 may be implemented as programs to be executed by the processor, and stored in the auxiliary storage part. When the programs are executed, the programs are expanded in the memory. The processor is configured to read out the programs from the memory, and execute the orders contained in the programs.

(Steel Plate to be Pickled)

In the pickling apparatus 1 according to some embodiments, a pickling process is performed on a steel plate 2 including the first steel plate portion 2*a* and the second steel plate portion 2*b* (see FIGS. 1A to 1C). The second steel plate portion 2*b* is connected to the tail end of the first steel plate portion 2*a* via the first connection portion 4 formed by welding or the like. The second steel plate portion 2*b* is a steel plate of a kind which requires a longer time be pickled than the first steel plate portion 2*a* when pickled under the same condition.

The steel plate 2 may include the third steel plate portion 2*c* in addition to the first steel plate portion 2*a* and the second steel plate portion 2*b* (see FIGS. 1A to 1C). The third steel plate portion 2*c* is connected to the tail end of the second steel plate portion 2*b* via the second connection portion 5 formed by welding or the like. The third steel plate portion 2*c* is a steel plate of a kind which requires a shorter time to be pickled than the second steel plate portion 2*b* when pickled under the same condition.

Furthermore, a steel which has a relatively high content of Si requires a relatively longer time of pickling. The second steel plate portion 2*b* may be a steel (e.g., a high-strength steel material) having a relatively high content of Si.

(Pickling Method)

Next, a method of pickling the steel plate 2 according to some embodiments will be described.

Figure 5:
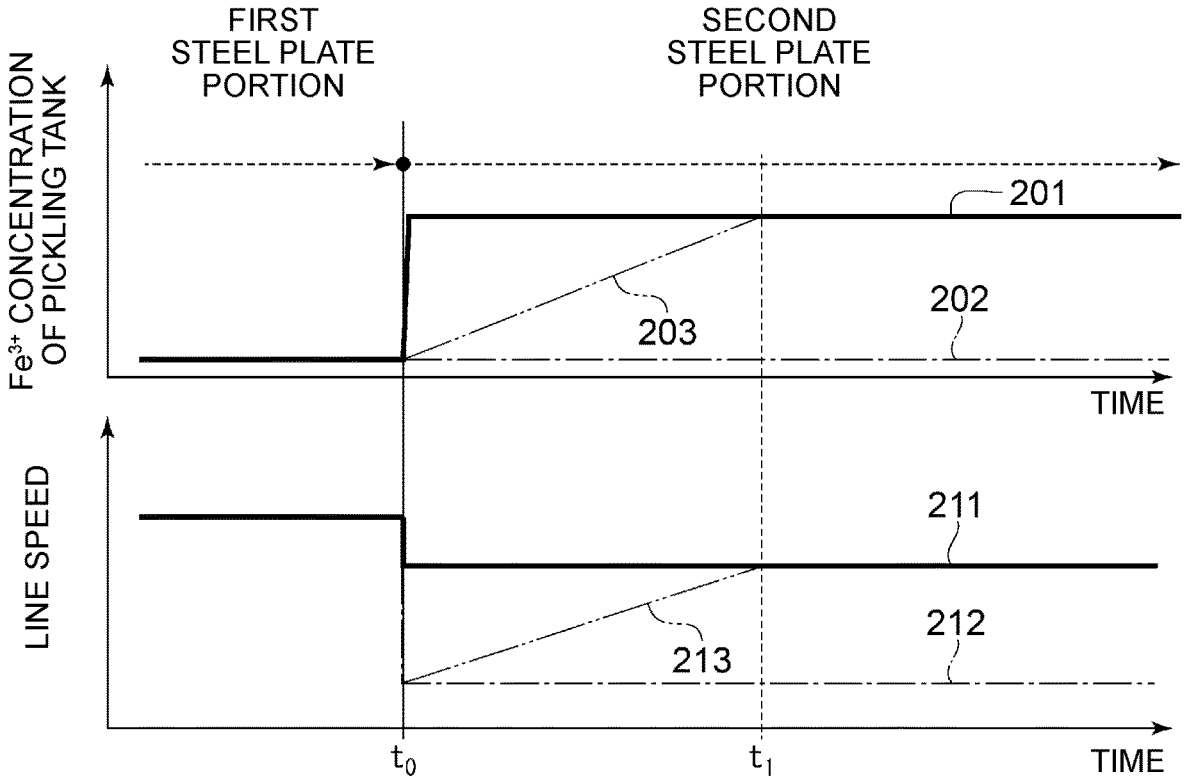
FIG. 5 is a graph showing a time-series change of the concentration of $Fe^{3+}$ and the line speed, etc. in the pickling method according to an embodiment.

First, with reference to FIG. 5, an outline of the pickling method according to some embodiments will be described. FIG. 5 is a graph showing a time-series change of the concentration of $Fe^{3+}$ in the acid solution 3 and the conveyance speed (line speed) of the steel plate 2, etc. in the pickling method according to an embodiment. FIG. 5 also shows the time-series changes (202, 203, 212, 213) of the concentration of $Fe^{3+}$ in the acid solution and the conveyance speed of the steel plate, etc. according to a conventional and typical pickling method.

In some embodiments, the steel plate 2 is pickled while the steel plate 2 is conveyed by the conveyance part 10 and the steel plate 2 is immersed in the acid solution 3 inside the pickling tank 12. In the example illustrated in FIG. 5, pickling of the steel plate 2 is performed from the time before time t0 to the time after time t1, and the first steel plate portion 2*a* of the steel plate 2 is conveyed continuously into the pickling tank 12 until time t0. At time t0, the first connection portion 4 (tip end portion of the second steel plate portion 2*b*) connecting the first steel plate portion 2*a* and the second steel plate portion 2*b* reaches the pickling tank 12, and the pickling is switched from pickling of the first steel plate portion 2*a* to pickling of the second steel plate portion 2*b*. After time t0, the second steel plate portion 2*b* of the steel plate 2 is conveyed into the pickling tank 12. Furthermore, after the first connection portion 4 reaches the pickling tank 12 and the pickling switches to pickling of the second steel plate portion 2*b* at time t0, a part of the first steel plate portion 2*a* continues to be pickled inside the pickling tank 12, until the first connection portion 4 (tail end portion of the first steel plate portion 2*a*) is discharged from the pickling tank 12.

While the first steel plate portion 2*a* is pickled in the pickling tank 12 (until time t0), the acid solution 3 is circulated between the pickling tank 12 and the oxidizing device 20 disposed in the circulation line 21, via the circulation line 21 connected to the pickling tank 12. Furthermore, the oxidizing device 20 oxidizes $Fe^{2+}$ in the acid solution 3 to $Fe^{3+}$ by using a gaseous oxidant. Accordingly, the concentration of $Fe^{3+}$ in the acid solution 3 in the pickling tank 12 is maintained at the concentration suitable for pickling of the first steel plate portion 2*a*.

Upon switching from pickling of the first steel plate portion 2*a* to pickling of the second steel plate portion 2*b*, at time t0, the liquid oxidant feeding part 30 starts feeding the liquid oxidant to at least one of the pickling tank 12 or to the circulation line 21. The valve (valve 37, 39, or 41) disposed in the liquid oxidant feeding line 34 is opened, and the liquid oxidant stored in the liquid oxidant tank 32 is fed to the pickling tank 12 or to the circulation line 21 via the liquid oxidant feeding line 34. Accordingly, the concentration 201 (see FIG. 5) of $Fe^{3+}$ in the pickling tank 12 increases quickly and considerably after time t0.

As depicted in FIG. 5, at time t0, upon switching from pickling of the first steel plate portion 2*a* to pickling of the second steel plate portion 2*b*, the conveyance speed 211 (see FIG. 5) of the steel plate 2 may be reduced.

In a case where a gaseous oxidant (air or oxygen, for instance) is used instead of a liquid oxidant to adjust the concentration of iron ion in the acid solution, the oxidation reaction of iron ion ($Fe^{2+}$ to $Fe^{3+}$) is relatively slow, as the rate of dissolution of the gaseous oxidant to the air solution is limited. Thus, when the steel plate to be pickled is switched from the first steel plate portion 2*a* to the second steel plate portion 2*b* which requires a longer time to be pickled at time t0 shown in FIG. 5, it is necessary to reduce the line speed (conveyance speed of the steel plate 2) than the previous speed (see the $Fe^{3+}$ concentration 220 and the line speed 212 in FIG. 5). Furthermore, even if the concentration of $Fe^{3+}$ in the acid solution 3 is to be increased by adjusting the supply amount of the gaseous oxidant or the like as indicated by the $Fe^{3+}$ concentration 203 in FIG. 5, it takes a long time to increase the concentration of $Fe^{3+}$, and thus it is difficult to increase the line speed much during a period after the line speed is reduced as described above and until the concentration of $Fe^{3+}$ in the acid solution 3 increases (see the line speed 213 in FIG. 5). Thus, the production efficiency of the steel plate 2 may deteriorate.

In contrast, in a case where the liquid oxidant is used, the oxidant is dissolved in a solution, and thus the oxidation reaction of iron ion in the acid solution 3 proceeds more quickly compared to a case in which a gaseous oxidant is used. Thus, it is easier to increase the concentration of $Fe^{3+}$ in the acid solution 3 quickly. In this regard, according to the above embodiment, upon switching from pickling of the first steel plate portion 2*a* to pickling of the second steel plate portion 2*b* (time t0 in FIG. 5), the liquid oxidant is supplied to the pickling tank 12 or to the circulation line 21. Thus, upon switching to pickling of the second steel plate portion 2*b* (pickling-resistant member) which requires a longer time to be pickled under the same condition, it is possible to quickly increase $Fe^{3+}$ in the acid solution 3 in the pickling tank 12. Accordingly, it is possible to maintain the conveyance speed (line speed) of the steel plate 2 at a high speed even when the kind of steel to be pickled is switched, and thus it is possible to improve the production efficiency of the steel plate 2.

Next, with reference to FIGS. 6 to 8, the pickling method according to some embodiments will be described more specifically.

Figure 6:
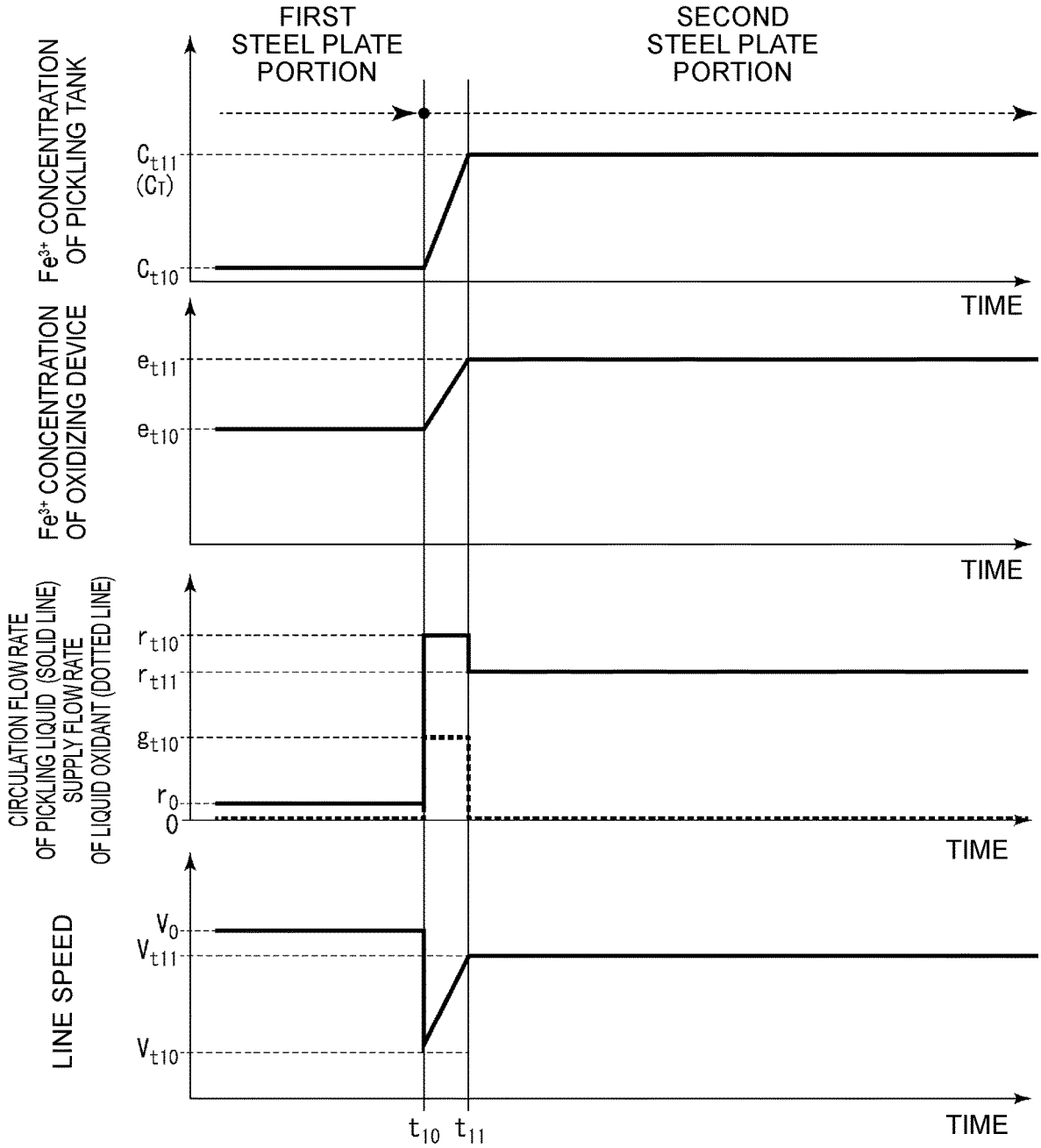
FIG. 6 is a graph showing a time-series change of the concentration of $Fe^{3+}$ and the line speed, etc. in the pickling method according to an embodiment.
Figure 7:
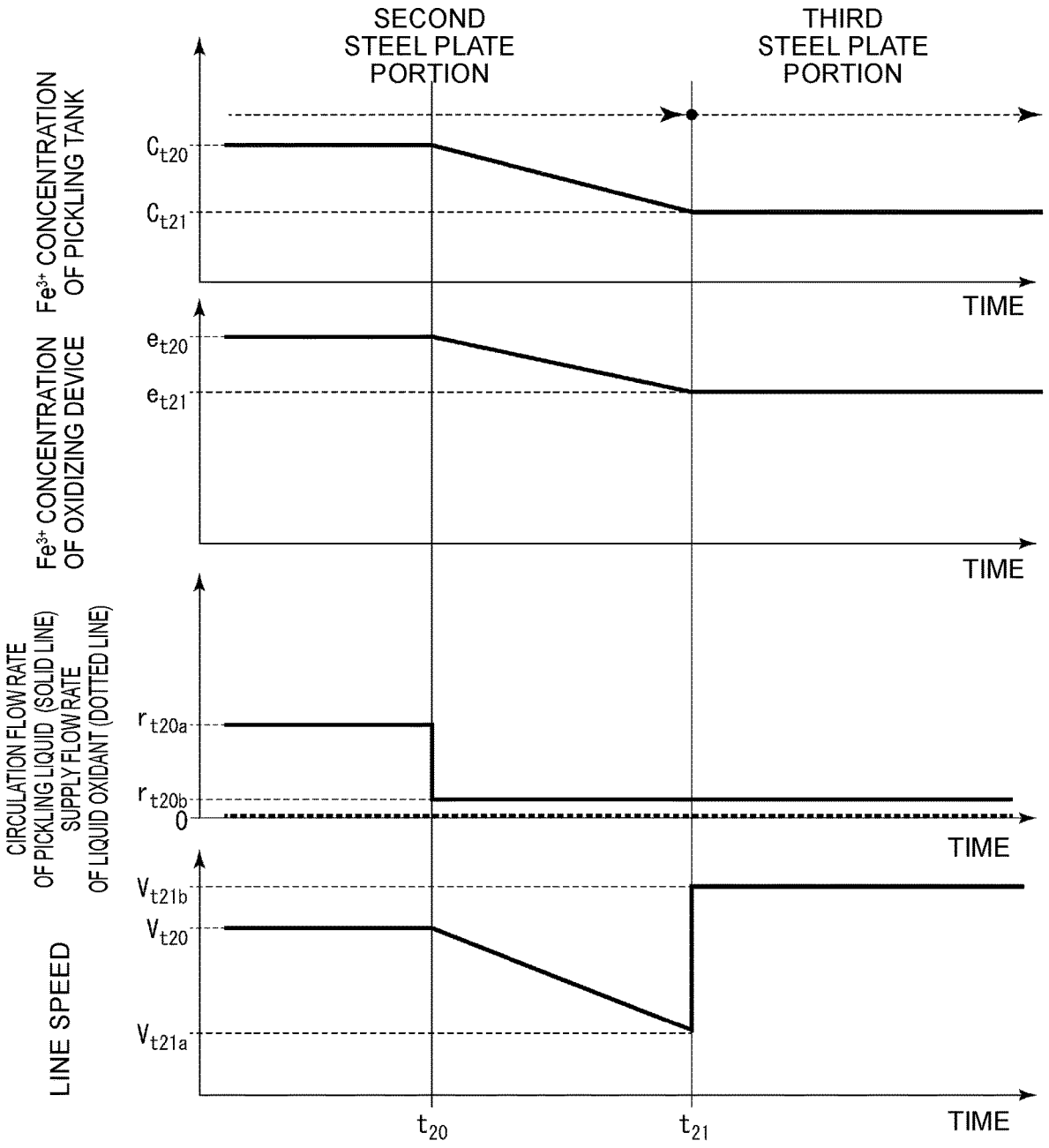
FIG. 7 is a graph showing a time-series change of the concentration of $Fe^{3+}$ and the line speed, etc. in the pickling method according to an embodiment.

FIGS. 6 and 7 are each a graph showing time-series changes of the concentration of $Fe^{3+}$ in the acid solution 3 and the conveyance speed (line speed) of the steel plate 2, etc. in the pickling method according to an embodiment. FIG. 6 is, like the case of FIG. 5, a graph illustrating pickling of the steel plate 2 by the pickling method according to an embodiment, including the timing of switch from pickling of the first steel plate portion 2*a* to pickling of the second steel plate portion 2*b*. FIG. 7 is a graph illustrating pickling of the steel plate 2 by the pickling method according to an embodiment, including the timing of switch from pickling of the second steel plate portion 2*b* to pickling of the third steel plate portion 2*c*.

In the embodiment depicted in FIG. 6, the steel plate 2 is pickled similarly to the case illustrated in FIG. 5. At time t10, the first connection portion 4 connecting the first steel plate portion 2*a* and the second steel plate portion 2*b* (tip end portion of the second steel plate portion 2*b*) reaches the pickling tank 12, and the pickling is switched from pickling of the first steel plate portion 2*a* to pickling of the second steel plate portion 2*b*.

Furthermore, similarly to the case illustrated in FIG. 5, while the first steel plate portion 2*a* is pickled in the pickling tank 12 (until time t10), the acid solution 3 is circulated between the oxidizing device 20 disposed in the circulation line 21 and the pickling tank 12, via the circulation line 21 connected to the pickling tank 12. Furthermore, the oxidizing device 20 oxidizes the $Fe^{2+}$ in the acid solution 3 to $Fe^{3+}$ by using a gaseous oxidant. Accordingly, the concentration of $Fe^{3+}$ in the acid solution 3 in the pickling tank 12 is maintained at the concentration ($C_{t10}$) suitable for pickling of the first steel plate portion 2*a*.

Furthermore, similarly to the case illustrated in FIG. 5, upon switching from pickling of the first steel plate portion 2*a* to pickling of the second steel plate portion 2*b*, at time t10, the liquid oxidant feeding part 30 starts feeding the liquid oxidant to at least one of the pickling tank 12 or to the circulation line 21. Accordingly, as shown in FIG. 6, the concentration of $Fe^{3+}$ in the pickling tank 12 increases quickly and considerably from $C_{t10}$ to $Ct_{11}$, between time t10 and time t11.

In some embodiments, feeding of the liquid oxidant is started within a period in which the first connection portion 4 connecting the first steel plate portion 2*a* and the second steel plate portion 2*b* exists inside the pickling tank 12, for instance, as shown in FIG. 6, at the time (time t10) when the first connection portion 4 reaches the pickling tank 12.

In the example shown in FIG. 6, at time t10, the feeding amount of the liquid oxidant is increased from zero to $qt_{10}$. Accordingly, it is possible to increase the concentration of $Fe^{3+}$ in the acid solution 3 in the pickling tank 12 quickly, after starting pickling of the second steel plate portion 2*b*. Thus, it is easier to maintain the conveyance speed of the steel plate 2 at a high speed after starting pickling of the second steel plate portion 2*b* being a pickling-resistant member, and thus it is possible to improve the production efficiency of the steel plate 2 effectively.

In the illustrative embodiment depicted in FIG. 6, upon switching from pickling of the first steel plate portion 2*a* to pickling of the second steel plate portion 2*b*, the conveyance speed (line speed) of the steel plate 2 is reduced from $V_0$ to $Vt_{10}$ at time t10.

By feeding the liquid oxidant to the acid solution 3 at time t10 in FIG. 6, it is possible to increase the concentration of $Fe^{3+}$ in the acid solution 3 in the pickling tank 12 relatively quickly, but it takes some time until the concentration of $Fe^{3+}$ in the acid solution 3 in the pickling tank 12 reaches the target value Ct (in the case illustrated in FIG. 6, the time from time t10 to time t11). With this regard, in the method according to the above described embodiment, upon switching from pickling of the first steel plate portion 2*a* to pickling of the second steel plate portion 2*b*, the conveyance speed of the steel plate 2 is reduced at time $t_{10}$, and thus it is possible to appropriately pickle the second steel plate portion 2*b* being a pickling-resistant member, by reducing the conveyance speed of the steel plate 2 after starting pickling of the second steel plate portion 2*b* being a pickling-resistant member and before the concentration of $Fe^{3+}$ in the acid solution 3 in the pickling tank 12 increases sufficiently. Accordingly, it is possible to suppress deterioration of the product quality.

In the embodiment illustrated in FIG. 6, the line speed is reduced to $Vt_{10}$ at time t10, and the line speed is increased to $Vt_{11}$ at time t11.

That is, upon switching from pickling of the first steel plate portion 2*a* to pickling of the second steel plate portion 2*b*, feeding of the liquid oxidant is started at time t10 and the conveyance speed of the steel plate is reduced, and then the conveyance speed of the steel plate is increased at time t11. Accordingly, it is possible to increase the conveyance speed of the steel plate 2 in accordance with an increase in $Fe^{3+}$ during pickling, and thereby it is possible to maintain the conveyance speed of the steel plate 2 at a high speed during pickling of the second steel plate portion 2*b* (pickling-resistant member). Thus, it is possible to improve the production efficiency of the steel plate.

In the embodiment illustrated in FIG. 6, upon switching from pickling of the first steel plate portion 2*a* to pickling of the second steel plate portion 2*b*, $Fe^{3+}$ derived from oxidation reaction ($Fe^{3+}$ derived from the oxidizing device) using the gaseous oxidant by the oxidizing device 20 from time t10 to time t11, and the concentration of $Fe^{3+}$ in the acid solution 3 in the pickling tank 12 is increased. More specifically, the supply amount of the gaseous oxidant to the acid solution 3 by the oxidizing device 20 is increased to raise the concentration of $Fe^{3+}$ in the acid solution 3 in the oxidizing device 20 from $et_{10}$ to $et_{11}$, and the circulation flow rate of the acid solution 3 between the oxidizing device 20 and the pickling tank 12 via the circulation line 21 is increased from $r_0$ to $rt_{10}$, thereby increasing the concentration of $Fe^{3+}$ in the acid solution 3 in the pickling tank 12.

Furthermore, in the illustrative embodiment depicted in FIG. 6, at time $t_{11}$ (that is, during pickling of the steel plate 2 in the pickling tank 12), supply of the liquid oxidant to the pickling tank 12 or the circulation line 21 is stopped. More specifically, $Fe^{3+}$ derived from the oxidizing device is increased from time $t_{10}$ to increase the concentration of $Fe^{3+}$ in the acid solution 3 in the pickling tank 12, and at time $t_{11}$, when it is possible to maintain the concentration of $Fe^{3+}$ in the acid solution 3 in the pickling tank 12 by supply of $Fe^{3+}$ from the oxidizing device 20, supply of the liquid oxidant to the pickling tank 12 or to the circulation line 21 is stopped. Herein, at this time, the circulation amount of the acid solution 3 between the oxidizing device 20 and the pickling tank 12 may be reduced to the extent such that it is possible to maintain the concentration of $Fe^{3+}$ in the acid solution 3 in the pickling tank 12 (in FIG. 6, the circulation amount is reduced to $r_{t11}$).

As described above, upon switching from pickling of the first steel plate portion 2*a* to pickling of the second steel plate portion, $Fe^{3+}$ derived from oxidation reaction using the gaseous oxidant by the oxidizing device 20 is increased (from time $t_{10}$ to time $t_{11}$), and the concentration of $Fe^{3+}$ in the acid solution 3 in the pickling tank 12 is increased to raise the concentration of $Fe^{3+}$ in the acid solution 3 in the pickling tank 12 sufficiently, and thereby it is possible to stop feeding of the liquid oxidant, which is relatively expensive (time t11). Accordingly, it is possible maintain the conveyance speed of the steel plate 2 and improve the production efficiency of the steel plate 2, while suppressing an increase in the cost for pickling the steel plate 2.

In some embodiments, supply of the liquid oxidant to the pickling tank 12 or to the circulation line 21 by the liquid oxidant feeding part 30 may be stopped when the concentration of $Fe^{3+}$ in the acid solution 3 in the pickling tank 12 reaches the target value Ct. Alternatively, supply of the above described liquid oxidant may be stopped before the tail end of the second steel plate portion 2*b* is discharged from the pickling tank 12. As described above. supply of the liquid oxidant is stopped during pickling of the steel plate 2, and thus the liquid oxidant is supplied to the pickling tank 12 or the circulation line 21 for a relatively short period of time. Accordingly, it is possible maintain the conveyance speed of the steel plate 2 and improve the production efficiency of the steel plate 2, while suppressing an increase in the cost for pickling the steel plate 2 by suppressing the usage amount of the liquid oxidant, which is relatively expensive.

In the embodiment illustrated in FIG. 7, the steel plate 2 including the second steel plate portion 2*b* and the third steel plate portion 2*c* connected to the second steel plate portion 2*b* via the second connection portion 5 is pickled. Until time t21, the second steel plate portion 2*b* of the steel plate 2 is pickled inside the pickling tank 12. At time t21, the second connection portion 5 connecting the second steel plate portion 2*b* and the third steel plate portion 2*c* (tip end portion of the third steel plate portion 2*c*) reaches the pickling tank 12, and the pickling is switched from pickling of the second steel plate portion 2*b* to pickling of the third steel plate portion 2*c*. After time t21, the third steel plate portion 2*c* of the steel plate 2 is conveyed into the pickling tank 12, and pickled. Also after the second connection portion 5 reaches the pickling tank 12 and the pickling switches to pickling of the third steel plate portion 2*c* at time t21, a part of the second steel plate portion 2*b* continues to be pickled inside the pickling tank 12, until the second connection portion 5 (tail end portion of the second steel plate portion 2*b*) is discharged from the pickling tank 12. In the time range shown in FIG. 7, the supply amount of the liquid oxidant by the liquid oxidant feeding part 30 is zero.

In some embodiments, as depicted in FIG. 7, upon switching from pickling of the second steel plate portion 2*b* to pickling of the third steel plate portion 2*c*, one of the supply amount of the gaseous oxidant to the acid solution 3 by the oxidizing device 20 or the circulation flow rate of the acid solution 3 between the oxidizing device 20 and the pickling tank 12 is reduced, and the concentration of $Fe^{3+}$ in the acid solution 3 in the pickling tank 12 is reduced. In the embodiment illustrated in FIG. 7, upon switching from pickling of the second steel plate portion 2*b* to pickling of the third steel plate portion 2*c*, the supply amount of the gaseous oxidant to the acid solution 3 by the oxidizing device 20 is reduced from time t20 before time t21 when the second connection portion 5 arrives at the pickling tank 12 to reduce the concentration of $Fe^{3+}$ in the acid solution 3 in the pickling tank 12 from $e_{t20}$ to $e_{t21}$, and the circulation flow rate of the acid solution 3 is reduced from $r_{t20a}$ to $r_{t20b}$, thereby reducing the concentration of $Fe^{3+}$ in the acid solution 3 in the pickling tank 12 from $C_{t20}$ to $C_{t21}$.

As described above, upon switching from pickling of the second steel plate portion 2*b* to pickling of the third steel plate portion 2*c*, $Fe^{3+}$ derived from the oxidizing device 20 is reduced to reduce the concentration of $Fe^{3+}$ in the acid solution 3 in the pickling tank 12, and thereby it is possible to suppress excessive pickling of the third steel plate portion 2*c* which requires a shorter period of time to be pickled under the same condition. Thus, it is possible to reduce pickling loss of the steel plate 2 and improve the yield ratio, thereby improving the production efficiency of the steel plate 2.

In some embodiments, as depicted in FIG. 7 for instance, upon switching from pickling of the second steel plate portion 2*b* to pickling of the third steel plate portion 2*c*, the conveyance speed of the steel plate 2 is increased. In the example depicted in FIG. 7, the line speed is reduced from $V_{t20}$ to $V_{t21a}$ from time t20 to time t21 when the second connection portion 5 arrives at the pickling tank 12, and the conveyance speed of the steel plate 2 is increased to $V_{t21b}$ at time t21 when the second connection portion 5 arrives at the pickling tank 12.

The third steel plate portion 2*c* requires a shorter period of time to be pickled than the second steel plate portion 2*b* under the same condition, and thus it is possible to pickle the third steel plate portion 2*c* sufficiently even when the conveyance speed of the steel plate 2 is increased upon switching to pickling of the third steel plate portion 2*c*. According to the embodiment described above, upon switching from pickling of the second steel plate portion 2*b* to the third steel plate portion 2*c*, the conveyance speed of the steel plate 2 is increased, and thereby it is possible to maintain the conveyance speed of the steel plate 2 at a high speed while pickling the third steel plate portion 2*c* sufficiently. Thus, it is possible to improve the production efficiency of the steel plate 2.

Figure 8:
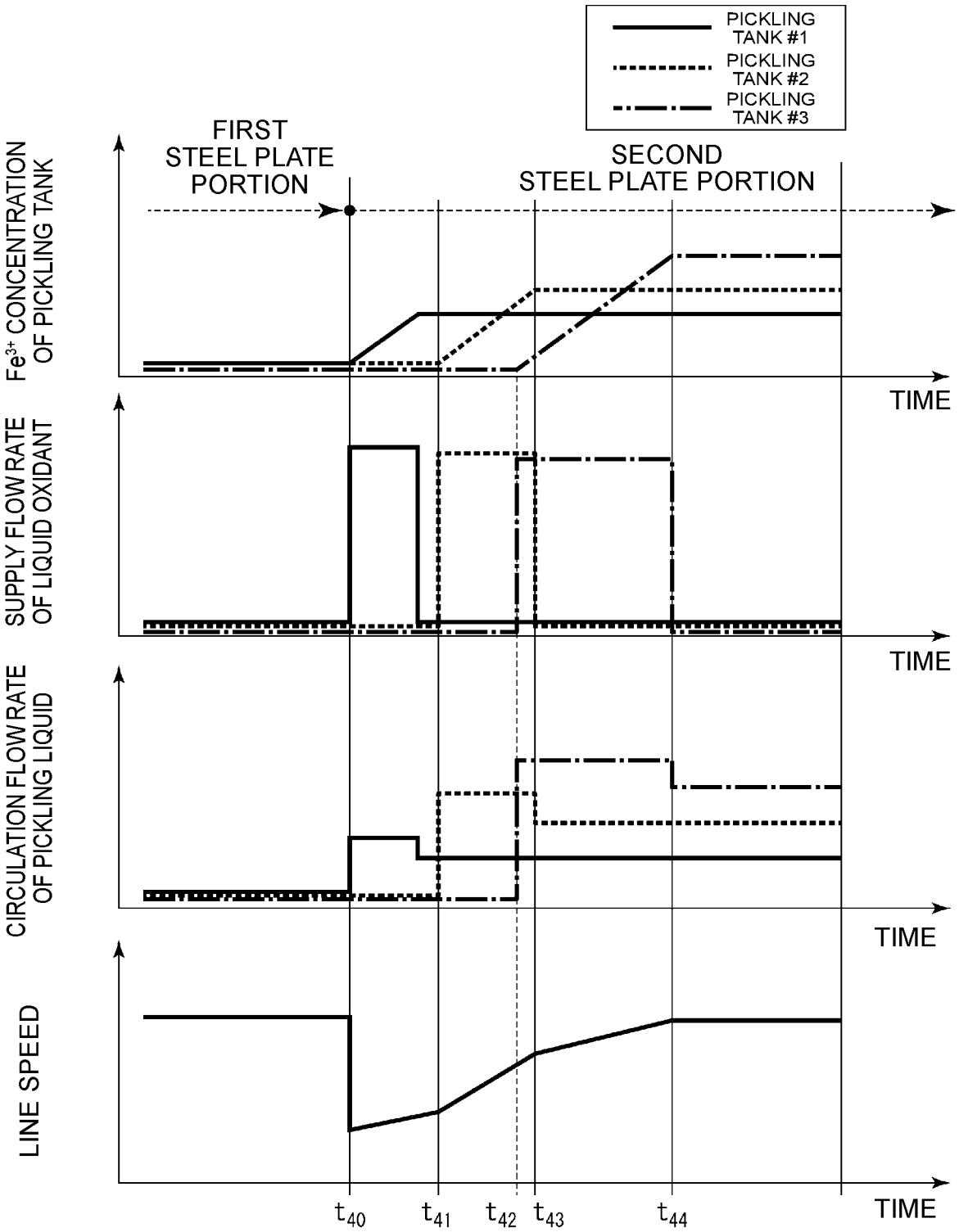
FIG. 8 is a graph showing a time-series change of the concentration of $Fe^{3+}$ and the line speed, etc. in the pickling method according to an embodiment.

FIG. 8 is a graph showing time-series changes of the concentration of $Fe^{3+}$ in the acid solution and the conveyance speed (line speed) of the steel plate 2, etc. in the pickling method according to an embodiment. FIG. 8 is a graph according to a pickling method for the pickling apparatus 1 including a plurality of pickling tanks 12 A to 12C and configured such that the acid solution 3 is supplied to the plurality of pickling tanks 12 A to 12C from the oxidizing device 20, and such that the liquid oxidant is supplied from the liquid oxidant feeding part 30.

In the embodiment depicted in FIG. 8, the steel plate 2 is pickled, and at time t40, the first connection portion 4 (tip end portion of the second steel plate portion 2*b*) connecting the first steel plate portion 2*a* and the second steel plate portion 2*b* reaches the pickling tank 12A (pickling tank #1) positioned at the most upstream side of the plurality of pickling tanks 12, and pickling is switched from pickling of the first steel plate portion 2*a* to pickling of the second steel plate portion 2*b*. Subsequently, the first connection portion 4 proceeds downstream, and reaches the pickling tank 12B (pickling tank #2) at time t41 and the pickling tank 12C (pickling tank #3; the most downstream pickling tank 12) at time t42 sequentially.

At the timing (time t40, t41, t42) when the first connection portion 4 reaches the respective pickling tanks 12 (12A to 12C), feeding of the liquid oxidant to the respective pickling tanks 12 (12A to 12C) or to the circulation lines 21 (21A to 21C) connected to the pickling tanks 12 is started in series. This is illustrated in the graph of the supply flow rate of the liquid oxidant in FIG. 8. Accordingly, the concentration of $Fe^{3+}$ in the acid solution 3 in the respective pickling tanks 12A to 12C is increased quickly. Therefore, for the pickling apparatus 1 including the plurality of pickling tanks 12 (12A to 12C), it is possible to maintain the conveyance speed (line speed) of the steel plate 2 at a high speed even when the kind of steel to be pickled is switched, and thus it is possible to improve the production efficiency of the steel plate 2.

As shown in FIG. 8, at the timing (time t40, t41, t42) when the first connection portion 4 reaches the respective pickling tanks 12 (12A to 12C), the circulation flow rate of the acid solution 3 between the respective pickling tanks 12A to 12C and the oxidizing devices 20 (20A to 20) is increased. Accordingly, it is possible to maintain the concentration of $Fe^{3+}$ in the acid solution 3 in the respective pickling tanks 12A to 12C appropriately. Furthermore, for this reason, it is possible to stop feeding of the liquid oxidant to the respective pickling tanks 12 (12A to 12C) or the circulation lines 21 (21A to 21C) connected to the pickling tanks 12.

In the illustrative embodiment depicted in FIG. 8, the line speed is changed at each of the following timings: when the first connection portion 4 enters the pickling tank 12A (time t40), when feeding of the liquid oxidant to the pickling tank 12B is started (time t41), when the concentration of $Fe^{3+}$ in the acid solution 3 in the pickling tank 12B reaches a predetermined value (time t43), and when the concentration of $Fe^{3+}$ in the acid solution 3 in the pickling tank 12C reaches a predetermined value (time t44). For instance, by changing the line speed appropriately at the above timings, it is possible to maintain the line speed of at a high speed even when the kind of steel to be pickled is switched, and thus it is possible to improve the production efficiency of the steel plate 2.

In some embodiments, the controller 100 is configured to control the line speed and the timing to change the line speed.

Figure 9:
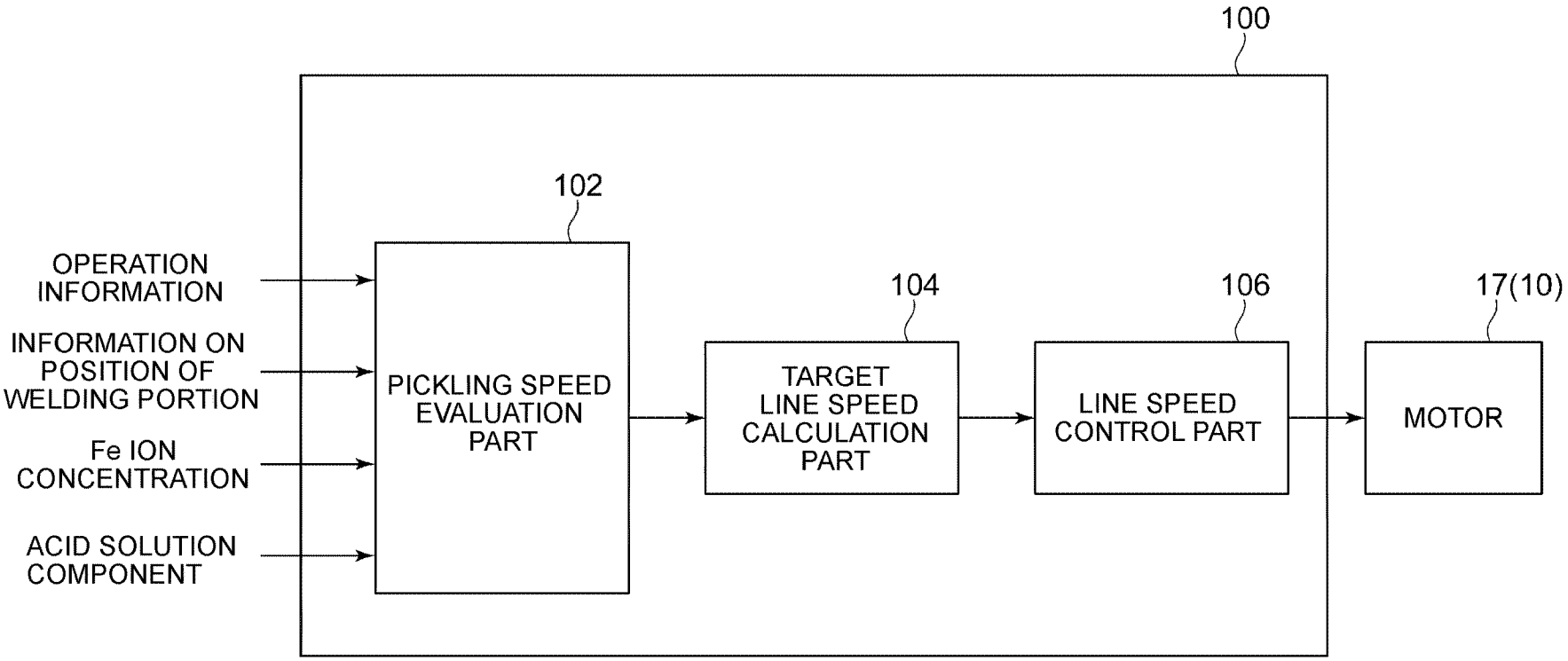
FIG. 9 is a block diagram illustrating the line speed control according to an embodiment.

FIG. 9 is a block diagram illustrating the line speed control by a controller 100 according to an embodiment. As depicted in FIG. 9, the controller 100 includes a pickling speed evaluation part 102, a target line speed calculation part 104, and a line speed control part 106.

The pickling speed evaluation part 102 is configured to receive signals that indicate operation information, position of the welding portion (the first connection portion 4 or the second connection portion 5) in the conveyance direction, concentration of Fe ion (concentration of $Fe^{2+}$ or concentration of $Fe^{3+}$) in the acid solution 3 in the pickling tank 12, and sensing information of components of the acid solution 3 in the pickling tank 12 or the like. The operation information includes the kind of steel of the steel plate 2 to be pickled and the operation conditions of the pickling apparatus 1 (temperature, pressure, and the like). The pickling speed evaluation part 102 evaluates the pickling speed of the steel plate 2 on the basis of the received signals.

The target line speed calculation part 104 calculates the target line speed by the conveyance part 10, on the basis of the evaluation result of the pickling speed by the pickling speed evaluation part 102. The line speed control part 106 controls the conveyance part 10 to achieve the calculated target line speed. For instance, the line speed control part 106 calculates an electric current command value for a motor 17 (motor which drives the conveyance roll 16) for obtaining the calculated target line speed, and sends the electric current command value to the motor.

In some embodiments, the controller 100 may obtain information on the position of the first connection portion 4 in the conveyance direction, and determine the timing to reduce the line speed on the basis of the information.

In this case, the timing to reduce the conveyance speed of the steel plate 2 is determined on the basis of the information on the position of the first connection portion 4 in the conveyance direction, and thus, for instance, it is possible to reduce the conveyance speed of the steel plate 2 at an appropriate timing in accordance with the timing to start pickling of the second steel plate portion 2*b* (that is, the timing when the second steel plate portion 2*b* reaches the pickling tank 12). Accordingly, it is possible to pickle the second steel plate portion 2*b* appropriately, and suppress deterioration of the product quality.

In some embodiments, the timing to start supply of the liquid oxidant may be determined on the basis of the information of the position of the first connection portion 4 in the conveyance direction. The supply start timing of the liquid oxidant may be determined in relation to the timing to reduce the conveyance speed of the steel plate 2.

In the above described embodiment, the timing to start supplying the liquid oxidant is determined on the basis of the information on the position of the first connection portion 4 in the conveyance direction, and thus, for instance, it is possible to start feeding of the liquid oxidant at an appropriate timing in accordance with the timing to start pickling of the second steel plate portion 2*b* (that is, the timing when the second steel plate portion 2*b* reaches the pickling tank 12). Thus, upon switching to pickling of the second steel plate portion 12*b*, it is possible to increase $Fe^{3+}$ in the acid solution 3 in the pickling tank 12 at an appropriately timing, and thus it is easier to maintain the conveyance speed of the steel plate 2 at a high speed. Thus, it is possible to improve the production efficiency of the steel plate 2.

In some embodiments, the controller 100 may be configured to adjust the concentration of Fe ion in the acid solution 3 in the pickling tank 12.

Figure 10:
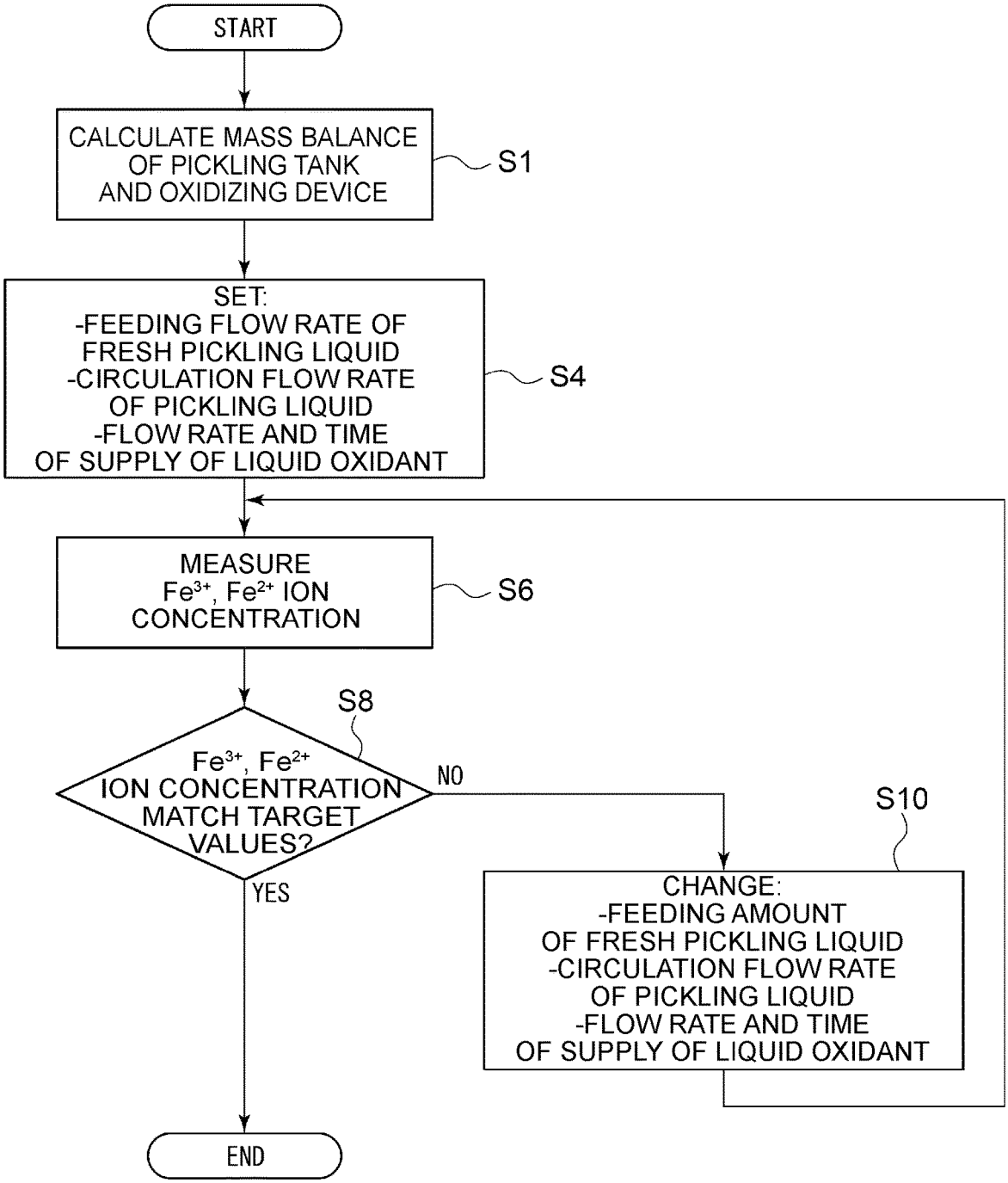
FIG. 10 is a flowchart illustrating the control of concentration of Fe ion according to an embodiment.

The concentration of Fe ion in the acid solution 3 in the pickling tank 12 may be adjusted according to the procedure shown in the flowchart of FIG. 10, for instance. FIG. 10 is a flowchart illustrating the control of concentration of Fe ion according to an embodiment.

As shown in the flow chart of FIG. 10, for instance, the mass balance at the pickling tanks 12 and the oxidizing devices 20 is calculated on the basis of the target concentration of Fe ion (target concentration of $Fe^{2+}$ and $Fe^{3+}$ ion) at the pickling tanks 12 and the oxidizing devices 20 and the operation conditions of the oxidizing devices 20 (step S1). The operation conditions of the oxidizing devices 20 include, for instance, the supply amount of the gaseous oxidant (oxygen) by the oxidizing device 20, the concentration of the gaseous oxidant, the bubbling gas flow rate, the temperature, the pressure, or the like.

Next, on the basis of the mass balance calculated in step S1, the feeding flow rate of fresh acid solution (hydrochloric acid or the like) to the pickling tank 12, the circulation flow rate of the acid solution 3 between the oxidizing device 20 and the pickling tank 12, and the supply amount flow rate and the supply time of the liquid oxidant by the liquid oxidant feeding part 30 are set (step S40).

Next, the concentration of $Fe^{3+}$ and the concentration of $Fe^{2+}$ in the acid solution 3 in the pickling tank 12 are measured (detected) (step S6), and it is determined whether the concentrations match the target values (step S8). In a case where the measurement value and the target value of the concentration of Fe ion do not match in step S8 (No in step S8), the set values of the feeding flow rate of fresh acid solution (hydrochloric acid or the like) to the pickling tank 12, the circulation flow rate of the acid solution 3 between the oxidizing device 20 and the pickling tank 12, and the supply amount flow rate and the supply time of the liquid oxidant are changed (step S10), and the procedure returns to step S6. On the other hand, in a case where the measurement value and the target value of the concentration of Fe ion match in step S8 (Yes in step S8), the set values of the feeding flow rate of fresh acid solution (hydrochloric acid or the like) to the pickling tank 12, the circulation flow rate of the acid solution 3 between the oxidizing device 20 and the pickling tank 12, and the supply amount flow rate and the supply time of the liquid oxidant are maintained, and the procedure is completed.

In some embodiments, as described with reference to FIG. 10 for instance, the concentration of $Fe^{3+}$ in the acid solution 3 in the pickling tank 12 may be detected, and the supply amount of the liquid oxidant may be determined on the basis of the difference between the detected concentration of $Fe^{3+}$ and the target concentration of $Fe^{3+}$ in the acid solution 3 in the pickling tanks 12 for pickling of the second steel plate portion 2*b*.

In this case, the supply amount of the liquid oxidant is determined on the basis of the difference between the measurement value and the target concentration of $Fe^{3+}$ in the acid solution in the pickling tank 12, and thus, by supplying the liquid oxidant on the basis of the supply amount determined accordingly, it is possible to increase $Fe^{3+}$ in the acid solution 3 in the pickling tank 12, and maintain the conveyance speed of the steel plate 2 at a high speed. Thus, it is possible to improve the production efficiency of the steel plate 2.

Furthermore, in some embodiments, during pickling of the second steel plate portion 2*b* and after stopping supply of the liquid oxidant to the pickling tank 12 or the circulation line 21, at least one of the supply amount of the gaseous oxidant or the circulation flow rate of the acid solution 3 between the oxidizing device 20 and the pickling tank 12 may be adjusted to maintain the concentration of $Fe^{3+}$ in the acid solution in the pickling tank 12 within a predetermined range including the target concentration of $Fe^{3+}$ in the acid solution 3 in the pickling tank 12 for pickling of the second steel plate portion 2*b*.

In this case, by adjusting the supply amount of gaseous oxidant by the oxidizing device 20 or the circulation flow rate of the acid solution 3 between the oxidizing device 20 and the pickling tank 12 during pickling of the second steel plate portion 2*b* and after stopping supply of the liquid oxidant, the concentration of $Fe^{3+}$ in the acid solution in the pickling tank 12 is maintained in the above described predetermined range. Thus, it is possible to maintain the $Fe^{3+}$ in the acid solution 3 in the pickling tank 12 appropriately after stopping supply of the liquid oxidant to maintain the conveyance speed of the steel plate 2 at a high speed, and improve the production efficiency of the steel plate 2. Furthermore, a gaseous oxidant, which is relatively inexpensive, is used to adjust the concentration of $Fe^{3+}$ in the acid solution 3 in the pickling tank 12, and thus it is possible to suppress a cost increase.

Hereinafter, a method for pickling a steel plate and a pickling facility according to some embodiments will be described briefly.

(1) According to at least one embodiment of the present invention, a method for pickling a steel plate having a first steel plate portion and a second steel plate portion which is connected to a tail end of the first steel plate portion and which requires a longer time for pickling than the first steel plate portion when pickled under the same condition, includes: a step of pickling the steel plate by immersing the steel plate in an acid solution in at least one pickling tank while conveying the steel plate; a step of circulating the acid solution, through a circulation line connected to any of the at least one pickling tank, between the pickling tank and an oxidizing device disposed in the circulation line; a step of oxidizing $Fe^{3+}$ in the acid solution to $Fe^{3+}$ by the oxidizing device using a gaseous oxidant; and a feeding start step of, upon switching from pickling of the first steel plate portion to pickling of the second steel plate portion, starting feeding of a liquid oxidant for oxidizing $Fe^{3+}$ in the acid solution to $Fe^{3+}$ to any of the at least one pickling tank or to the circulation line.

In a case where the liquid oxidant is used, an oxidant is dissolved in a solution, and thus the oxidation reaction of iron ion during pickling proceeds more quickly compared to a case in which a gaseous oxidant is used. Thus, it is easier to increase the concentration of $Fe^{3+}$ in the acid solution quickly. In this regard, according to the above method (1), upon switching from pickling of the first steel plate portion to pickling of the second steel plate portion, the liquid oxidant is supplied to the pickling tank or to the circulation line. Thus, when switching to pickling of the second steel plate portion (pickling-resistant member) which requires a longer time to be pickled under the same condition, it is possible to quickly increase $Fe^{3+}$ in the acid solution in the pickling tank. Accordingly, it is possible to maintain the conveyance speed (line speed) of the steel plate at a high speed even when the kind of steel to be pickled is switched, and thus it is possible to improve the production efficiency of the steel plate.

(2) In some embodiments, in the above method (1), feeding of the liquid oxidant to the at least one pickling tank or the circulation line is started within a period of time during which a first connection portion being a connection portion connecting the first steel plate portion and the second steel plate portion exists in the at least one pickling tank.

According to the above method (2), feeding of the liquid oxidant is started within a period of time during which the first connection portion being a connection portion connecting the first steel plate portion and the second steel plate portion exists in the pickling tank, and thus it is possible to increase the concentration of $Fe^{3+}$ in the acid solution quickly after starting pickling of the second steel plate portion. Thus, it is easier to maintain the conveyance speed of the steel plate at a high speed after starting pickling of the second steel plate portion being a pickling-resistant member, and thus it is possible to improve the production efficiency of the steel plate effectively.

(3) In some embodiments, in the above method (1) or (2), the pickling method further includes a speed reduction step of, upon switching from pickling of the first steel plate portion to pickling of the second steel plate portion, reducing a conveyance speed of the steel plate.

By feeding the liquid oxidant to the acid solution, it is possible to increase the concentration of $Fe^{3+}$ in the acid solution relatively quickly, but it takes some time until the concentration of $Fe^{3+}$ in the acid solution reaches the target value. With this regard, according to the above method (3), upon switching from pickling of the first steel plate portion to pickling of the second steel plate portion, the conveyance speed of the steel plate is reduced, and thus it is possible to appropriately pickle the second steel plate portion by reducing the conveyance speed of the steel plate after starting pickling of the second steel plate portion and before the concentration of $Fe^{3+}$ in the acid solution in the pickling tank increases sufficiently. Accordingly, it is possible to suppress deterioration of the product quality.

(4) In some embodiments, in the above method (3), the pickling method further includes: a step of obtaining information on a position, in the conveyance direction, of a first connection portion being a connection portion connecting the first steel plate portion and the second steel plate portion; and a step of deciding a timing to reduce the conveyance speed of the steel plate on the basis of the information.

According to the above method (4), the timing to reduce the conveyance speed of the steel plate is determined on the basis of the information on the position of the first connection portion in the conveyance direction, and thus, for instance, it is possible to reduce the conveyance speed of the steel plate at an appropriate timing in accordance with the timing to start pickling of the second steel plate portion (that is, the timing when the second steel plate portion reaches the pickling tank). Accordingly, it is possible to pickle the second steel plate portion appropriately, and suppress deterioration of the product quality.

(5) In some embodiments, in the above method (3) or (4), the pickling method further includes: a step of, after the feeding start step and the speed reduction step, increasing the conveyance speed of the steel plate.

According to the above method (5), upon switching from pickling of the first steel plate portion to pickling of the second steel plate portion, feeding of the liquid oxidant to the acid solution is started and the conveyance speed of the steel plate is reduced, and then the conveyance speed of the steel plate is increased. Accordingly, it is possible to increase the conveyance speed of the steel plate in accordance with an increase in $Fe^{3+}$ during pickling, and thereby it is possible to maintain the conveyance speed of the steel plate at a high speed during pickling of the second steel plate portion (pickling-resistant member). Thus, it is possible to improve the production efficiency of the steel plate.

(6) In some embodiments, in any one of the above methods (1) to (5), the pickling method further includes a step of, upon switching from pickling of the first steel plate portion to pickling of the second steel plate portion, increasing at least one of a supply amount of the gaseous oxidant to the acid solution by the oxidizing device or a circulation flow rate of the acid solution between the oxidizing device and the at least one pickling tank to increase a concentration of $Fe^{3+}$ in the acid solution in the pickling tank.

According to the above method (6), upon switching from pickling of the first steel plate portion to pickling of the second steel plate portion, $Fe^{3+}$ derived from oxidation reaction using the gaseous oxidant by the oxidizing device ($Fe^{3+}$ derived from the oxidizing device) is increased to raise the concentration of $Fe^{3+}$ in the acidic solution in the pickling tank. Thus, when the concentration of $Fe^{3+}$ in the acid solution in the pickling tank is sufficiently high, it is possible to stop feeding of the liquid oxidant, which is relatively expensive. Accordingly, it is possible maintain the conveyance speed of the steel plate at a high speed and improve the production efficiency of the steel plate, while suppressing an increase in the cost for pickling the steel plate.

(7) In some embodiments, in any one of the above methods (1) to (6), the pickling method further includes: a step of, during pickling of the steel plate in the at least one pickling tank, stopping supply of the liquid oxidant to the at least one pickling tank or the circulation line.

According to the above method (7), supply of the liquid oxidant is stopped during pickling of the steel plate, and thus it is possible to supply the liquid oxidant to the pickling tank or the circulation line for a relatively short period of time. Accordingly, it is possible maintain the conveyance speed of the steel plate at a high speed and improve the production efficiency of the steel plate, while suppressing an increase in the cost for pickling the steel plate by suppressing the usage amount of the liquid oxidant, which is relatively expensive.

(8) In some embodiments, in the above method (7), the steel plate includes a third steel plate portion which is connected to a tail end of the second steel plate portion and which requires a shorter time to be pickled than the second steel plate portion when pickled under the same condition, and the pickling method further includes a step of, upon switching from pickling of the second steel plate portion to pickling of the third steel plate portion, reducing at least one of a supply amount of the gaseous oxidant to the acid solution by the oxidizing device or a circulation flow rate of the acid solution between the oxidizing device and the at least one pickling tank to reduce a concentration of $Fe^{3+}$ in the acid solution in the pickling tank.

According to the above method (8), upon switching from pickling of the second steel plate portion to pickling of the third steel plate portion, $Fe^{3+}$ derived from the oxidizing device is reduced to lower the concentration of $Fe^{3+}$ in the acid solution in the pickling tank, and thereby it is possible to suppress excessive pickling of the third steel plate portion which requires a shorter period of time to be pickled under the same condition. Thus, it is possible to reduce pickling loss of the steel plate and improve the yield ratio, thereby improving the production efficiency of the steel plate.

(9) In some embodiments, the above method (8) further includes a step of, upon switching from pickling of the second steel plate portion to pickling of the third steel plate portion, increasing a conveyance speed of the steel plate.

The third steel plate portion requires a shorter period of time to be pickled than the second steel plate portion under the same condition, and thus it is possible to pickle the third steel plate portion sufficiently even when the conveyance speed of the steel plate is increased upon switching to the third steel plate portion. According to the above method (9), upon switching from pickling of the second steel plate portion to the third steel plate portion, the conveyance speed of the steel plate is increased, and thereby it is possible to maintain the conveyance speed of the steel plate at a high speed while pickling the third steel plate portion sufficiently. Thus, it is possible to improve the production efficiency of the steel plate.

(10) In some embodiments, in any one of the above methods (1) to (9), the at least one pickling tank includes a plurality of pickling tanks arranged along a conveyance direction of the steel plate. The pickling method includes a step of transferring the acid solution in the pickling tank positioned at a downstream side in the conveyance direction to the pickling tank positioned at an upstream side in the conveyance direction. The feeding start step includes feeding the liquid oxidant to at least one of the plurality of pickling tanks or to the circulation line connected to the at least one of the plurality of pickling tanks.

According to the above method (10), with the pickling apparatus including the plurality of pickling tanks, upon switching from pickling of the first steel plate portion to pickling of the second steel plate portion, the liquid oxidant is supplied to any of the pickling tanks or to the circulation line connected to any of the pickling tanks. Thus, when switching to pickling of the second steel plate portion (pickling-resistant member) which requires a longer time to be pickled under the same condition, it is possible to quickly increase the concentration of $Fe^{3+}$ in the acid solution in the pickling tank. Accordingly, it is possible to maintain the conveyance speed of the steel plate at a high speed even when the kind of steel to be pickled is switched, and thus it is possible to improve the production efficiency of the steel plate.

(11) In some embodiments, in the above method (10), feeding of the liquid oxidant to the plurality of pickling tanks or the circulation line connected to the pickling tanks is started sequentially in an order of passing of a first connection portion being a connection portion connecting the first steel plate portion and the second plate portion.

According to the above method (11), feeding of the liquid oxidant to the plurality of pickling tanks or the circulation line connected to the pickling tanks is started sequentially in an order of passing of a first connection portion being a connection portion connecting the first steel plate portion and the second plate portion. Thus, it is possible to increase the concentration of $Fe^{3+}$ in the acid solution in the plurality of pickling tanks quickly, and thus it is easier to maintain the conveyance speed of the steel plate at a high speed after switching to pickling of the second steel plate portion. Thus, it is possible to improve the production efficiency of the steel plate effectively.

(12) In some embodiments, in any one of the above methods (1) to (11), the method further includes: a step of obtaining information on a position of the first connection portion in the conveyance direction; and a step of deciding a timing to start supply of the liquid oxidant on the basis of the information.

According to the above method (12), the timing to start supplying the liquid oxidant is determined on the basis of the information on the position of the first connection portion in the conveyance direction, and thus, for instance, it is possible to start feeding of the liquid oxidant at an appropriate timing in accordance with the timing to start pickling of the second steel plate portion (that is, the timing when the second steel plate portion reaches the pickling tank). Thus, upon switching to pickling of the second steel plate portion, it is possible to increase the concentration of $Fe^{3+}$ in the acid solution in the pickling tank at an appropriately timing, and thus it is easier to maintain the conveyance speed of the steel plate at a high speed. Thus, it is possible to improve the production efficiency of the steel plate.

(13) In some embodiments, in any one of the above methods (1) to (12), the method further includes: a step of detecting a concentration of $Fe^{3+}$ in the acid solution in the pickling tank; and a step of deciding a supply amount of the liquid oxidant on the basis of a difference between the detected concentration of $Fe^{3+}$ and a target concentration of $Fe^{3+}$ in the acid solution in the pickling tank for pickling of the second steel plate portion.

According to the above method (13), the concentration of $Fe^{3+}$ in the pickling tank is detected, and the supply amount of the liquid oxidant is determined on the basis of the difference between the detected concentration of $Fe^{3+}$ and the target concentration of $Fe^{3+}$ in the acid solution in the pickling tanks for pickling of the second steel plate portion. Therefore, by supplying the liquid oxidant on the basis of the supply amount determined accordingly, it is possible to increase $Fe^{3+}$ in the acid solution in the pickling tank, and maintain the conveyance speed of the steel plate at a high speed. Thus, it is possible to improve the production efficiency of the steel plate.

(14) In some embodiments, in any one of the above methods (1) to (13), the method further includes a step of, during pickling of the second steel plate portion and after stopping supply of the liquid oxidant to the at least one pickling tank or to the circulation line, adjusting at least one of a supply amount of the gaseous oxidant or a circulation flow rate of the acid solution between the oxidizing device and the at least one pickling tank so as to maintain a concentration of $Fe^{3+}$ in the acid solution in the pickling tank within a predetermined range including a target concentration of $Fe^{3+}$ in the acid solution in the pickling tank for pickling of the second steel plate portion.

According to the above method (14), by adjusting at least one of the supply amount of gaseous oxidant in the oxidizing device or the circulation flow rate of the acid solution between the oxidizing device and the pickling tank during pickling of the second steel plate portion and after stopping supply of the liquid oxidant, the concentration of $Fe^{3+}$ in the acid solution in the pickling tank is maintained in the above described predetermined range. Thus, it is possible to maintain the concentration of $Fe^{3+}$ in the acid solution in the pickling tank appropriately after stopping supply of the liquid oxidant and maintain the conveyance speed of the steel plate at a high speed, and improve the production efficiency of the steel plate. Furthermore, a gaseous oxidant, which is relatively inexpensive, is used to adjust the concentration of $Fe^{3+}$ in the acid solution in the pickling tank, and thus it is possible to suppress a cost increase.

(15) According to at least one embodiment of the present invention, a pickling apparatus for pickling a steel plate having a first steel plate portion and a second steel plate portion which is connected to a tail end of the first steel plate portion and which requires a longer time for pickling than the first steel plate portion when pickled under the same condition, includes: at least one pickling tank storing an acid solution; a conveyance part configured to convey the steel plate while immersing the steel plate in the acid solution in the at least one pickling tank; a circulation line for circulating the acid solution inside any of the at least one pickling tank, the circulation line being connected to the at least one pickling tank; an oxidizing device disposed in the circulation line and configured to oxidize $Fe^{3+}$ in the acid solution to $Fe^{3+}$ by using a gaseous oxidant; and a liquid oxidant feeding part capable of feeding a liquid oxidant for oxidizing $Fe^{2+}$ in the acid solution to $Fe^{3+}$ to any one of the at least one pickling tank or to the circulation line.

According to the above configuration (15), upon switching from pickling of the first steel plate portion to pickling of the second steel plate portion, the liquid oxidant is supplied to the pickling tank or the circulation line. Thus, when switching to pickling of the second steel plate portion (pickling-resistant member) which requires a longer time to be pickled under the same condition, it is possible to quickly increase the concentration of $Fe^{3+}$ in the acid solution in the pickling tank. Accordingly, it is possible to maintain the conveyance speed (line speed) of the steel plate at a high speed even when the kind of steel to be pickled is switched, and thus it is possible to improve the production efficiency of the steel plate.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

DESCRIPTION OF REFERENCE NUMERAL

1 Pickling apparatus
2 Steel plate
2*a* First steel plate portion
2*b* Second steel plate portion
2*c* Third steel plate portion
3 Acid solution
4 First connection portion
5 Second connection portion
10 Conveyance part
12, 12A to 12C Pickling tank
16 Conveyance roll
17 Motor
18 Acid-solution supply part
19 Acid-solution discharge part
20, 20A to 20C Oxidizing device
21, 21A to 21C Circulation line
22, 22A to 22C Extract line
24, 24A to 24C Return line
30 Liquid oxidant feeding part
32 Liquid oxidant tank
33 Liquid oxidant pump
34 Liquid oxidant feeding line
36, 36A to 36C First feeding line
37, 37A to 37C Valve
38, 38A to 38C Second feeding line
39, 39A to 39C Valve
40, 40A to 40C Third feeding line
41, 41A to 41C Valve
100 Controller
102 Pickling speed evaluation part
104 Target line speed calculation part
106 Line speed control part

The invention claimed is:

1. A method for pickling a steel plate having a first steel plate portion and a second steel plate portion which is connected to a tail end of the first steel plate portion and which requires a longer time for pickling than the first steel plate portion when pickled under the same condition, comprising:

a step of pickling the steel plate by immersing the steel plate in an acid solution in at least one pickling tank while conveying the steel plate;

a step of circulating the acid solution, through a circulation line connected to any of the at least one pickling tank, between the pickling tank and an oxidizing device disposed in the circulation line;

a step of oxidizing $Fe^{2+}$ in the acid solution to $Fe^{3+}$ by the oxidizing device using a gaseous oxidant; and a feeding start step of, upon switching from pickling of the first steel plate portion to pickling of the second steel plate portion, starting feeding of a liquid oxidant for oxidizing $Fe^{2+}$ in the acid solution to $Fe^{3+}$ to any of the at least one pickling tank or to the circulation line.

2. The method for pickling a steel plate according to claim 1, wherein feeding of the liquid oxidant to the at least one pickling tank or the circulation line is started within a period of time during which a first connection portion being a connection portion connecting the first steel plate portion and the second steel plate portion exists in the at least one pickling tank.

3. The method for pickling a steel plate according to claim 1, further comprising:

a speed reduction step of, upon switching from pickling of the first steel plate portion to pickling of the second steel plate portion, reducing a conveyance speed of the steel plate.

4. The method for pickling a steel plate according to claim 3, further comprising:

a step of obtaining information on a position, in a conveyance direction, of a first connection portion being a connection portion connecting the first steel plate portion and the second steel plate portion; and a step of deciding a timing to reduce the conveyance speed of the steel plate on the basis of the information.

5. The method for pickling a steel plate according to claim 3, further comprising:

a step of, after the feeding start step and the speed reduction step, increasing the conveyance speed of the steel plate.

6. The method for pickling a steel plate according to claim 1, further comprising a step of, upon switching from pickling of the first steel plate portion to pickling of the second steel plate portion, increasing at least one of a supply amount of the gaseous oxidant to the acid solution by the oxidizing device or a circulation flow rate of the acid solution between the oxidizing device and the at least one pickling tank to increase a concentration of $Fe^{3+}$ in the acid solution in the pickling tank.

7. The method for pickling a steel plate according to claim 1, further comprising:

a step of, during pickling of the steel plate in the at least one pickling tank, stopping supply of the liquid oxidant to the at least one pickling tank or the circulation line.

8. The method for pickling a steel plate according to claim 7, wherein the steel plate includes a third steel plate portion which is connected to a tail end of the second steel plate portion and which requires a shorter time to be pickled than the second steel plate portion when pickled under the same condition, and wherein the method further comprises a step of, upon switching from pickling of the second steel plate portion to pickling of the third steel plate portion, reducing at least one of a supply amount of the gaseous oxidant to the acid solution by the oxidizing device or a circulation flow rate of the acid solution between the oxidizing device and the at least one pickling tank to reduce a concentration of $Fe^{3+}$ in the acid solution in the pickling tank.

9. The method for pickling a steel plate according to claim 8, further comprising:

a step of, upon switching from pickling of the second steel plate portion to pickling of the third steel plate portion, increasing a conveyance speed of the steel plate.

10. The method for pickling a steel plate according to claim 1, wherein the at least one pickling tank includes a plurality of pickling tanks arranged along a conveyance direction of the steel plate, wherein the method includes a step of transferring the acid solution in the pickling tank positioned at a downstream side in the conveyance direction to the pickling tank positioned at an upstream side in the conveyance direction, and wherein the feeding start step includes feeding the liquid oxidant to at least one of the plurality of pickling tanks or to the circulation line connected to the at least one of the plurality of pickling tanks.

11. The method for pickling a steel plate according to claim 10, wherein feeding of the liquid oxidant to the plurality of pickling tanks or the circulation line connected to the pickling tanks is started sequentially in an order of passing of a first connection portion being a connection portion connecting the first steel plate portion and the second plate portion.

12. The method for pickling a steel plate according to claim 1, further comprising:

a step of obtaining information on a position of a first connection portion in the conveyance direction, the first connection portion being a connection portion connecting the first steel plate portion and the second plate portion; and a step of deciding a timing to start supply of the liquid oxidant on the basis of the information.

13. The method for pickling a steel plate according to claim 1, further comprising:

a step of detecting a concentration of $Fe^{3+}$ in the acid solution in the pickling tank; and a step of deciding a supply amount of the liquid oxidant on the basis of a difference between the detected concentration of $Fe^{3+}$ and a target concentration of $Fe^{3+}$ in the acid solution in the pickling tank for pickling of the second steel plate portion.

14. The method for pickling a steel plate according to claim 1, further comprising:

a step of, during pickling of the second steel plate portion and after stopping supply of the liquid oxidant to the at least one pickling tank or to the circulation line, adjusting at least one of a supply amount of the gaseous oxidant or a circulation flow rate of the acid solution between the oxidizing device and the at least one pickling tank so as to maintain a concentration of $Fe^{3+}$ in the acid solution in the pickling tank within a predetermined range including a target concentration of $Fe^{3+}$ in the acid solution in the pickling tank for pickling of the second steel plate portion.

15. A pickling apparatus for pickling a steel plate having a first steel plate portion and a second steel plate portion which is connected to a tail end of the first steel plate portion and which requires a longer time for pickling than the first steel plate portion when pickled under the same condition, comprising:

at least one pickling tank storing an acid solution;

a conveyance part configured to convey the steel plate while immersing the steel plate in the acid solution in the at least one pickling tank;

a circulation line for circulating the acid solution inside any of the at least one pickling tank, the circulation line being connected to the at least one pickling tank;

an oxidizing device disposed in the circulation line and configured to oxidize $Fe^{2+}$ in the acid solution to $Fe^{3+}$ by using a gaseous oxidant; and a liquid oxidant feeding part capable of feeding a liquid oxidant for oxidizing $Fe^{2+}$ in the acid solution to $Fe^{3+}$ to any one of the at least one pickling tank or to the circulation line, wherein the liquid oxidant feeding part is configured to, upon switching from pickling of the first steel plate portion to pickling of the second steel portion, start feeding of a liquid oxidant for oxidizing $Fe^{2+}$ in the acid solution to $Fe^{3+}$ to any of the at least one pickling tank or to the circulation line.

* * * * *